United States Patent [19]

Murali et al.

[11] Patent Number: 4,527,954

[45] Date of Patent: Jul. 9, 1985

[54] PUMPING APPARATUS

[75] Inventors: Beegamudre N. Murali; Jeffrey S. Rosenberg; Clinton W. Cole, all of Duncan, Okla.

[73] Assignee: Halliburton Company, Duncan, Okla.

[21] Appl. No.: 457,843

[22] Filed: Jan. 14, 1983

[51] Int. Cl.[3] ..... F04B 17/00; F04B 35/02; F15B 9/03; F15B 9/09

[52] U.S. Cl. ..... 417/46; 417/342; 417/346; 417/403; 91/361; 91/363 A; 91/363 R

[58] Field of Search ..... 417/339, 342, 346, 46, 417/401, 403, 344; 91/361, 363 A, 363 R, 361

[56] References Cited

U.S. PATENT DOCUMENTS

| | | | |
|---|---|---|---|
| Re. 25,568 | 5/1964 | Sherrod . | |
| 624,854 | 5/1899 | Oddie . | |
| 1,760,213 | 5/1930 | Schaer . | |
| 2,204,854 | 6/1940 | Hambly . | |
| 2,212,667 | 8/1940 | Mayer . | |
| 2,463,552 | 8/1949 | Newhall . | |
| 2,508,298 | 5/1950 | Saari . | |
| 2,811,925 | 11/1957 | Crookston . | |
| 2,819,835 | 1/1958 | Newhall . | |
| 2,897,762 | 8/1959 | Houvener . | |
| 3,077,838 | 2/1963 | Maglott . | |
| 3,146,721 | 9/1964 | Schwing . | |
| 3,201,031 | 8/1965 | Maglott . | |
| 3,234,882 | 2/1966 | Douglas et al. . | |
| 3,249,053 | 5/1966 | Govan . | |
| 3,279,382 | 10/1966 | Bennett . | |
| 3,279,383 | 10/1966 | Smith . | |
| 3,295,451 | 1/1967 | Smith . | |
| 3,326,135 | 6/1967 | Smith . | |
| 3,331,329 | 7/1967 | Bauer . | |
| 3,516,761 | 6/1970 | Scroggins . | |
| 3,618,470 | 11/1971 | Mueller et al. . | |
| 3,650,638 | 3/1972 | Cole . | |
| 3,662,652 | 5/1972 | Cole . | |
| 3,713,296 | 1/1973 | Black . | |
| 3,763,744 | 10/1973 | Fournell et al. . | |
| 3,773,438 | 11/1973 | Hall et al. . | |
| 3,778,193 | 12/1973 | Reinert . | |
| 3,792,643 | 2/1974 | Scheafer . | |
| 3,818,801 | 6/1974 | Kime | 91/533 X |
| 3,847,511 | 11/1974 | Cole . | |
| 3,872,769 | 3/1975 | Rosling . | |
| 3,893,790 | 7/1975 | Mayer . | |
| 3,898,916 | 8/1975 | Renner et al. . | |
| 3,981,622 | 9/1976 | Hall et al. . | |
| 4,160,627 | 7/1979 | Cole | 417/403 |
| 4,161,905 | 7/1979 | Ota . | |
| 4,358,989 | 11/1982 | Tordenmalm | 91/361 |

FOREIGN PATENT DOCUMENTS

| | | | |
|---|---|---|---|
| 1360800 | 7/1974 | United Kingdom . | |
| 421793 | 8/1974 | U.S.S.R. | 417/339 |

*Primary Examiner*—Richard E. Gluck
*Assistant Examiner*—Theodore Olds
*Attorney, Agent, or Firm*—Lucian W. Beavers; James R. Duzan; Thomas R. Weaver

[57] ABSTRACT

A multiple-mode, multiplex pumping apparatus includes circuit control elements for initializing the apparatus by placing each of the pistons and plungers in each pumping section of the multiplex pumping apparatus at a respective initial starting point. The pumping apparatus also includes electronic circuit elements for controlling the inlet valves, exhaust valves and precompression valves of the hydraulic circuit of the pumping apparatus. The apparatus includes phase control circuit elements for controlling the separation of the leading edges of the plungers of two of the pumping sections of the apparatus when the apparatus is operating as a quadruplex pump. The pumping apparatus also includes elecrtronic circuit elements for insuring that each plunger of each pumping section stops at a fixed stopping point. The apparatus also includes electronic circuit elements for controlling the volume of fluid in the rod end portions of each of the pumping sections. There are also electronic circuit elements for controlling the mode in which the apparatus functions in response to the pressure and stroke of the main pump powering the apparatus. The apparatus still further includes electronic circuit elements for converting the pumping apparatus from quadruplex operation to triplex operation.

18 Claims, 26 Drawing Figures

PUMPING APPARATUS

Figure 1:
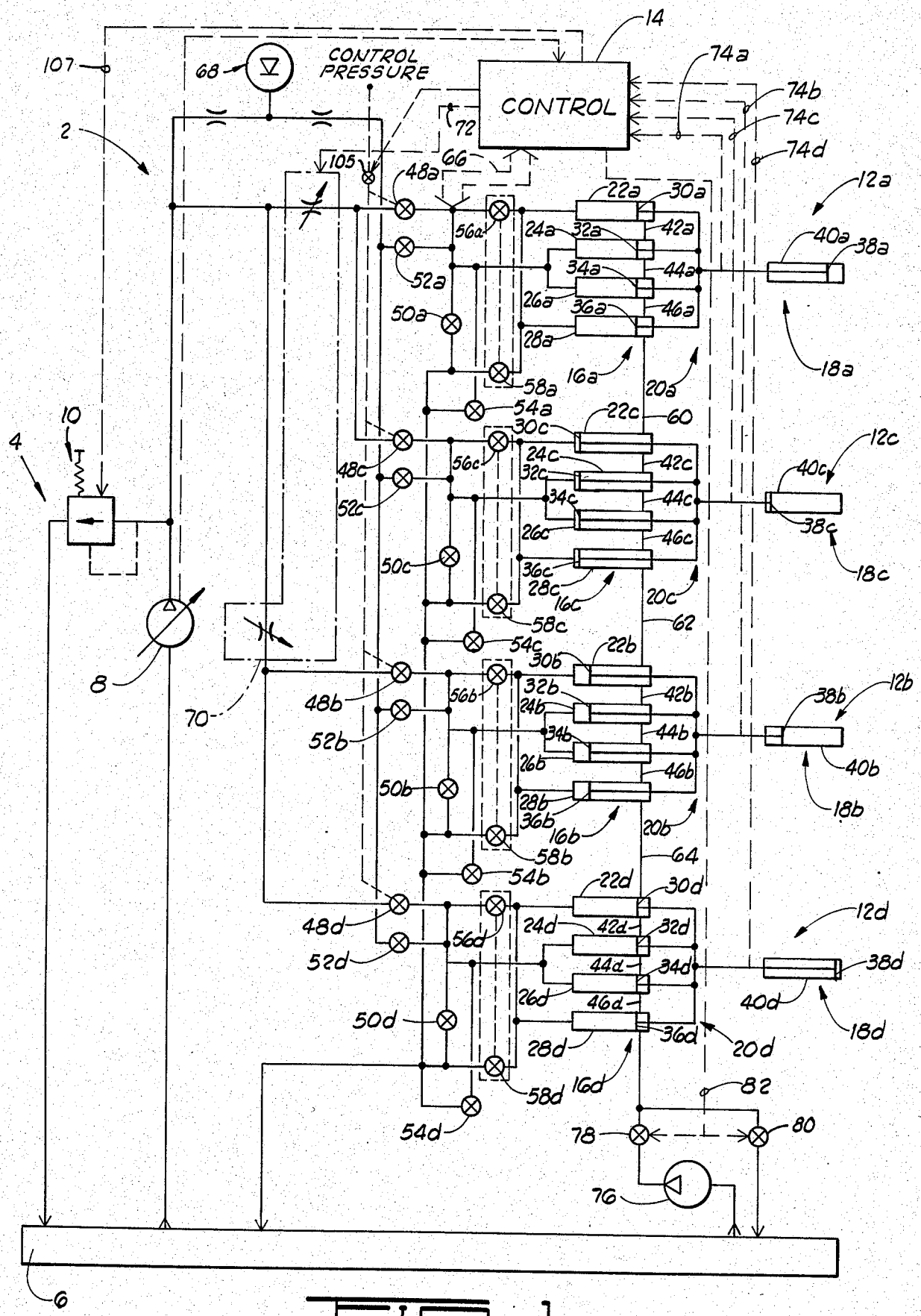

This invention relates generally to pumping apparatus and more particularly, but not by way of limitation, to multiple-mode quadruplex pumping apparatus in which the positions of fluid-driving plungers are initialized, the phases between two of the plungers on discharge are maintained, each plunger is driven to a fixed stopping point, the volume of fluid displaced by pistons driving the plungers on discharge is controlled and used to return a piston driving a plunger on suction, and one of the pumping sections of the pumping apparatus may be disabled while maintaining the other pumping sections enabled.

In the oil and gas industry high pressure, high flowrate pumping systems are needed for pumping fluids, such as well treatment fluids, into wells. Various types of such pumping systems are known to the art. For example, there are multiplex intensifiers having three pumping sections operating at different stages of a pumping cycle. These stages are generally the discharge stage, the suction stage and the precompression stage. Each section includes a power end having a piston driven by a hydraulic pump and a fluid end having a plunger driven by the power end piston. This construction permits the fluid to be pumped by the plungers at relatively high pressures in response to lower pressures provided by the hydraulic pump.

Such pumping systems are needed to properly deliver fluids at pressures up to 20,000 pounds per square inch (psi), for example, while using motive power in the hydraulic pump of only 2,000 horsepower, for example, and while encountering suction pressures of 35 psi in the pumping section on suction, for example, without damaging either the pumping system or the discharge conduit into which the fluid is pumped. Although such pumping systems exist, there is the need for an improved multiplex pump which permits stable, continuous flows of fluids to be pumped at high pressures and yet which also permits the pumping to occur at different power-end piston area to fluid-end plunger area ratios in a manner analogous to the different gear ratios available in an automobile. Having the availability of different power-end area to fluid-end area ratios enables the pumping system to use a smaller motive power capacity to achieve a greater rangeability of pressures and flow rates for a constant horsepower. There is also the need for an improved multiplex pump which can function adequately on less than all of the pumping sections without having to terminate the pumping operation.

The present invention overcomes the shortcomings of the prior art in failing to provide such an improved pumping apparatus by providing a novel and improved multiple-mode, multiplex pumping apparatus. The pumping apparatus of the present invention maintains stable, continuous flows of fluid at pressures and flow rates selectable by means for automatically changing power-end area to fluid-end area ratios. The present invention also is capable of maintaining an adequate flow even when one of the pumping sections of the apparatus is not utilized.

Broadly, the present invention provides a pumping apparatus comprising four pumping sections and a control means for controlling the operation of the four pumping sections. The control means includes initialization means for placing a first plunger means of the first pumping section at a first position as an initial leading discharge plunger means, for placing a second plunger means of the second pumping section at a second position as an initial trailing discharge plunger means, for placing a third plunger means of the third pumping section at a third position as an initial precompression plunger means, and for placing a fourth plunger means of the fourth pumping section at a fourth position as an initial suction plunger means. The control means also includes phase control means for controlling the spacing between any of the first, second, third and fourth plunger means functioning as the leading discharge plunger means and any of the first, second, third and fourth plunger means functioning as the trailing discharge plunger means. The control means still further includes stop point control means for controlling the positions at which each of the first, second, third and fourth plunger means stops at the end of its movement as the leading discharge plunger means. The control means also includes mode control means for shifting power end piston means of each of the four pumping sections between a first mode of operation and a second mode of operation in response to the detected pressure and stroke of a drive pump to which the apparatus is connectible. The control means additionally includes means for operating the apparatus either in quadruplex wherein all of the four pumping sections are energizable or in triplex wherein only three of the four pumping sections are energizable. The control means further includes means for controlling the quantity of a fluid contained in respective end portions of the power end piston means of each of the four pumping sections.

Therefore, from the foregoing, it is a general object of the present invention to provide a novel and improved pumping apparatus. Other and further objects, features and advantages of the present invention will be readily apparent to those skilled in the art when the following description of the preferred embodiment is read in conjunction with the accompanying drawings.

FIG. 1 is a schematic circuit and functional block diagram of a preferred embodiment of the present invention.

FIGS. 2A–2E disclose a schematic circuit diagram of the initialization and simulation portion of the preferred embodiment control means of the present invention.

FIGS. 3A–3F disclose a schematic circuit diagram of the inlet valve means, exhaust valve means, and precompression circuit control and detection portions of the preferred embodiment control means of the present invention.

Figure 4B:
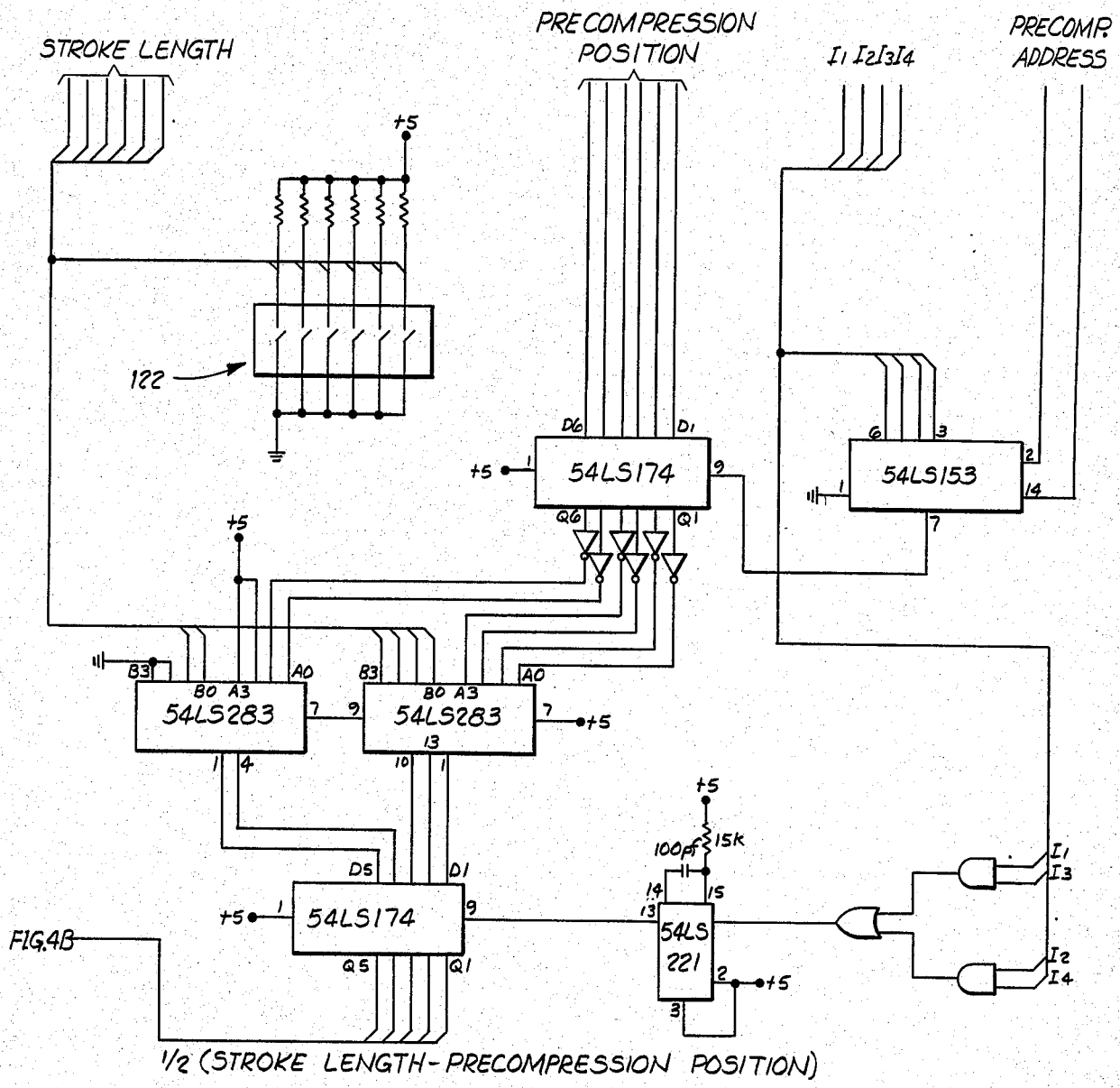
Figure 4B:
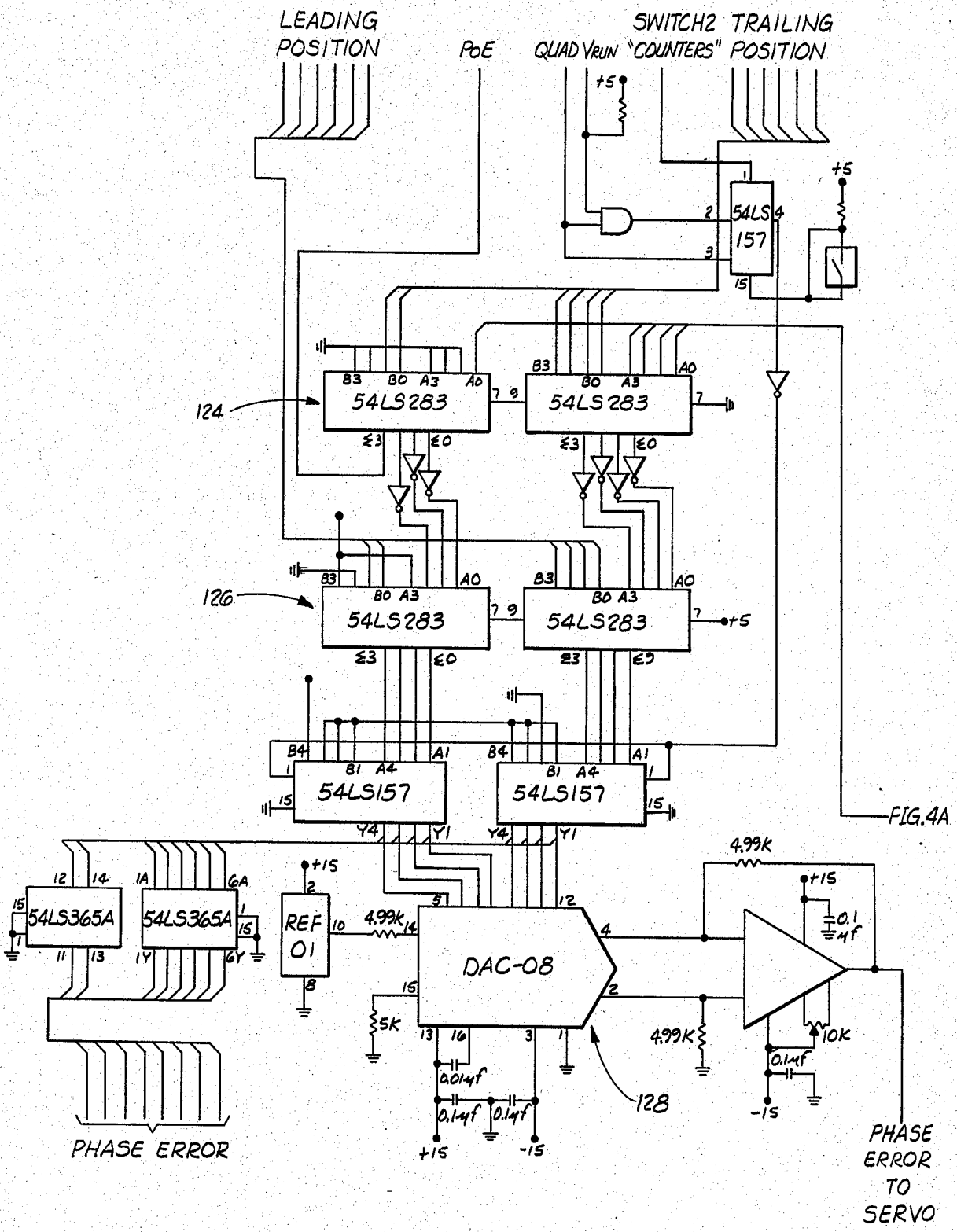

FIGS. 4A–4B disclose a schematic circuit diagram of the phase control portion of the preferred embodiment control means of the present invention.

Figure 5A:
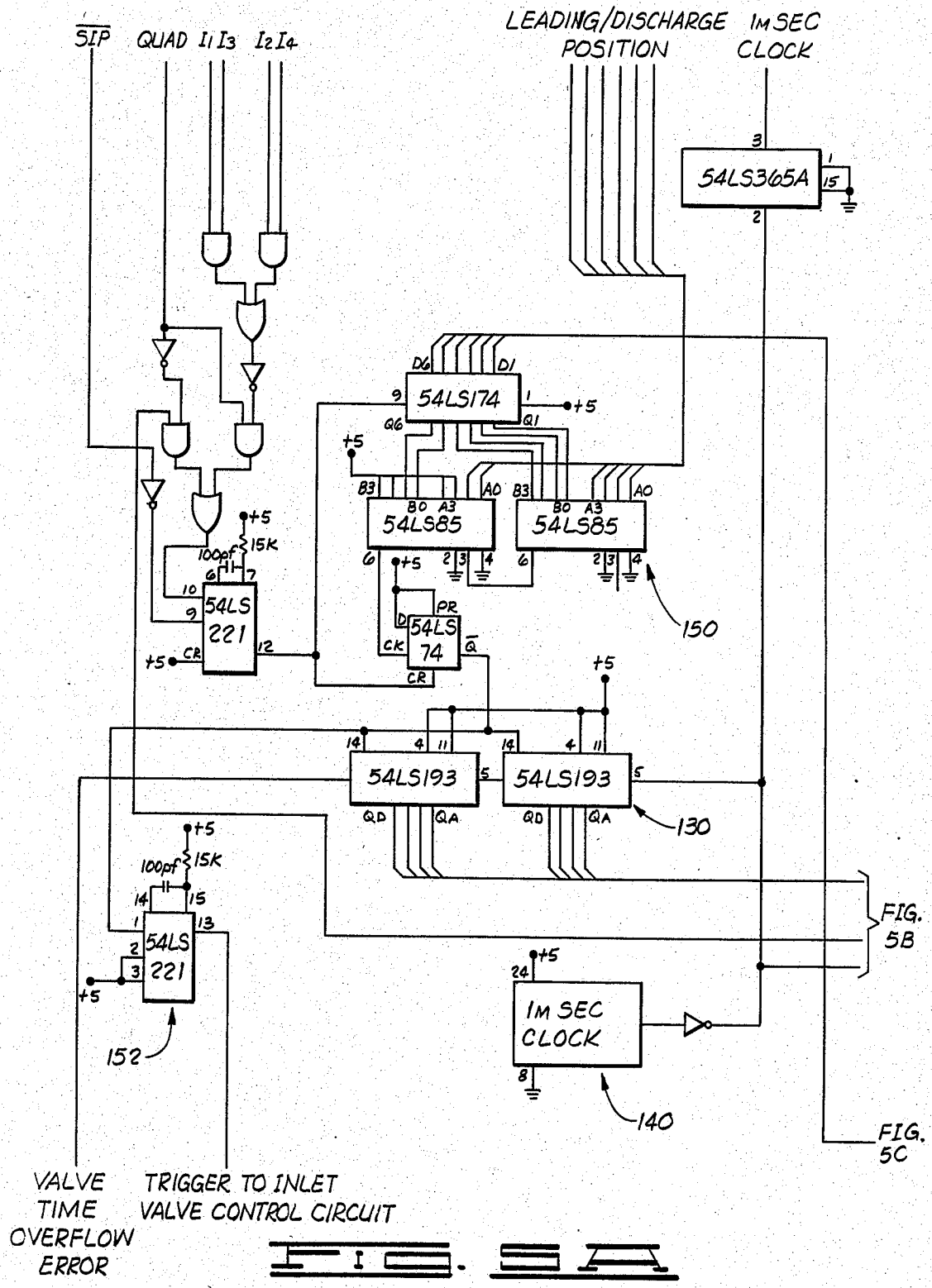
Figure 5B:
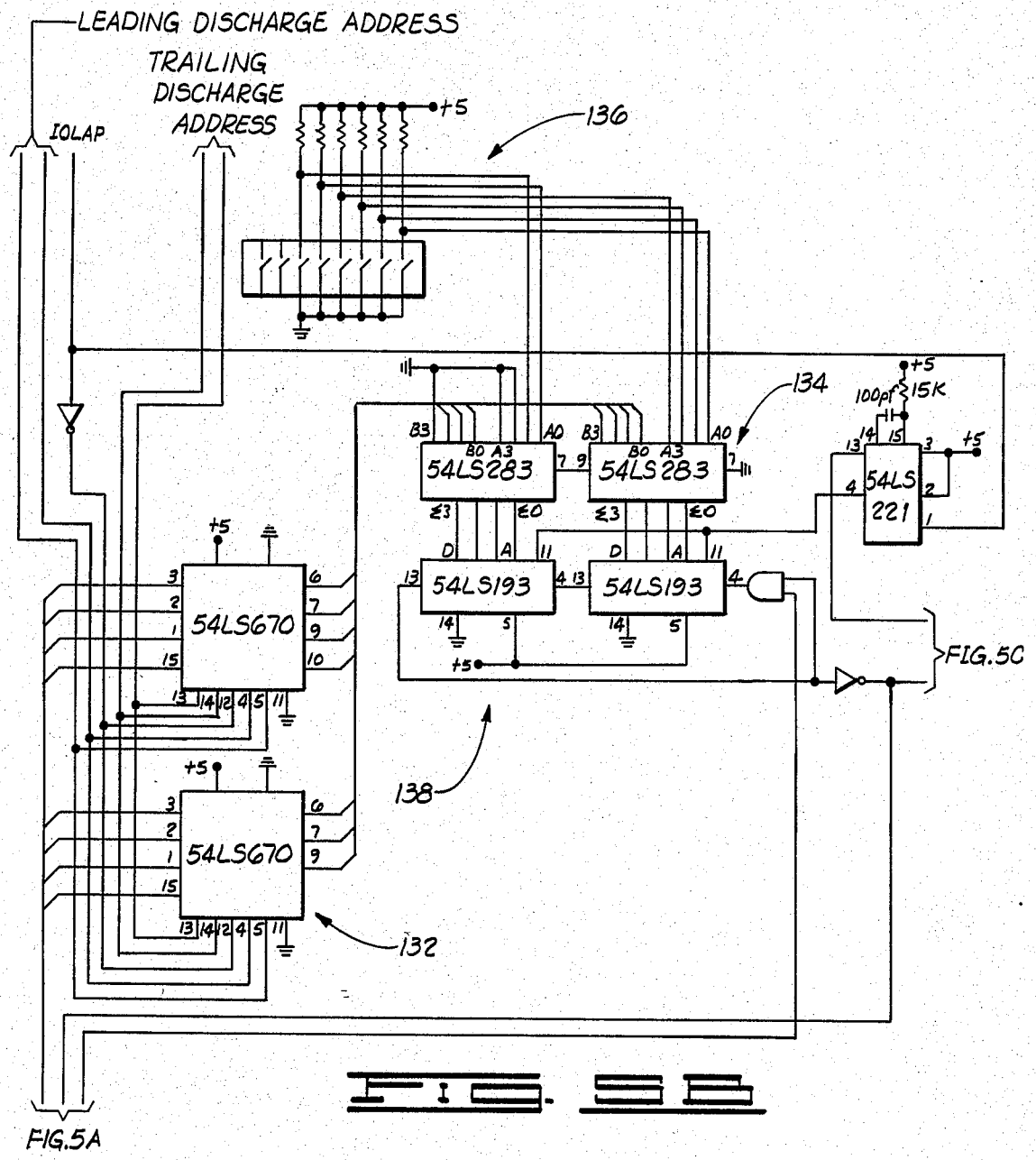
Figure 5C:
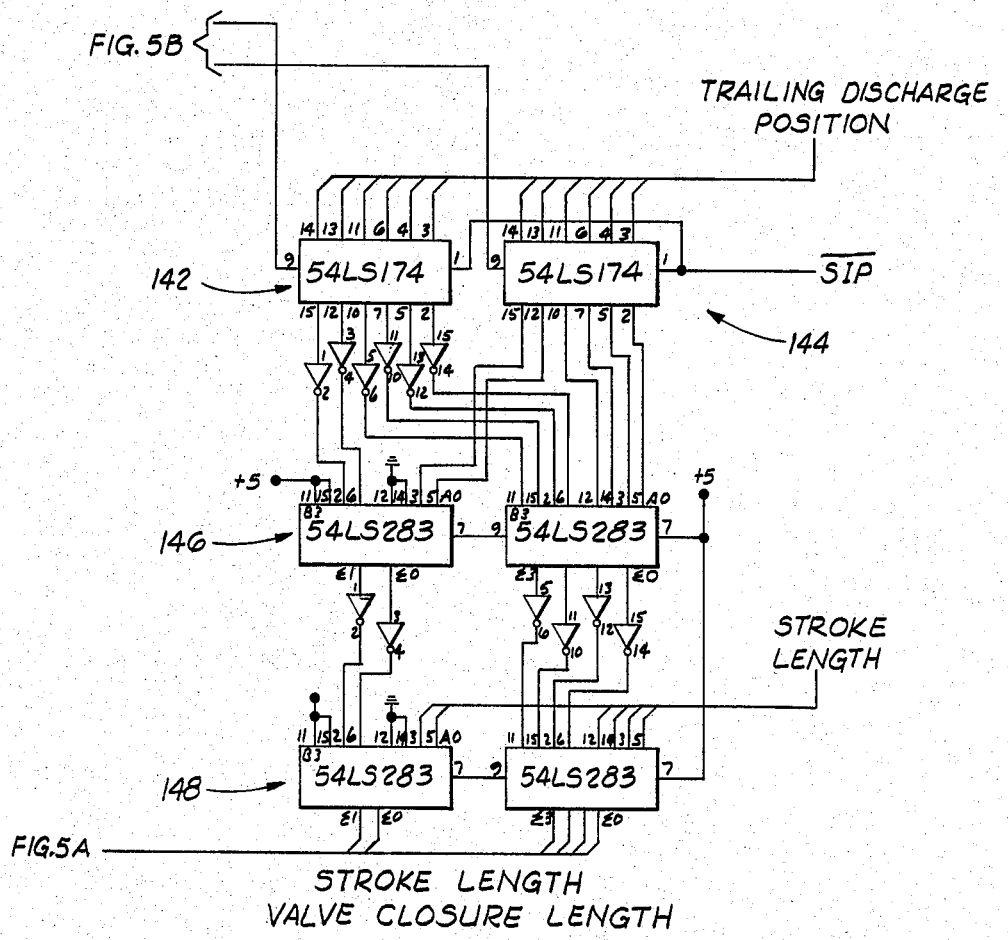

FIGS. 5A–5C disclose a schematic circuit diagram of the fixed stopping point control portion of the preferred embodiment control means of the present invention.

FIGS. 6A–6D disclose a schematic circuit diagram of the return volume control portion of the preferred embodiment control means of the present invention.

Figure 7B:
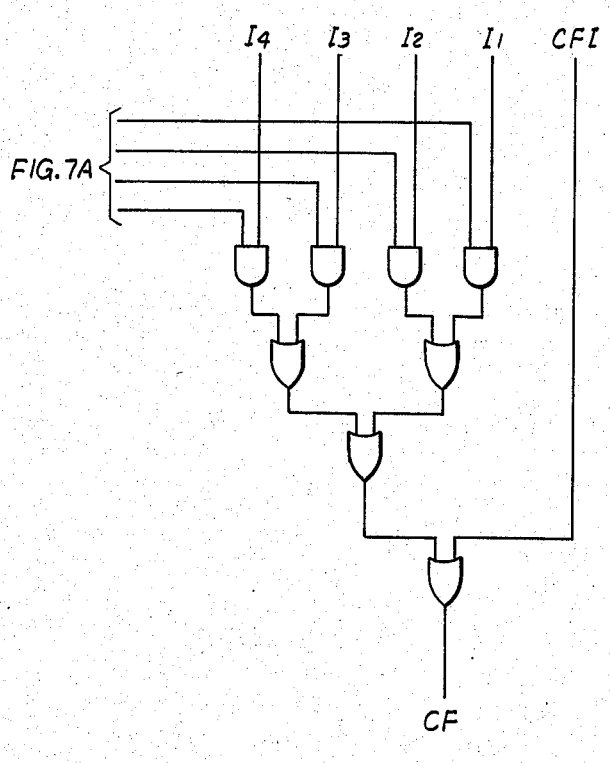
Figure 7A:
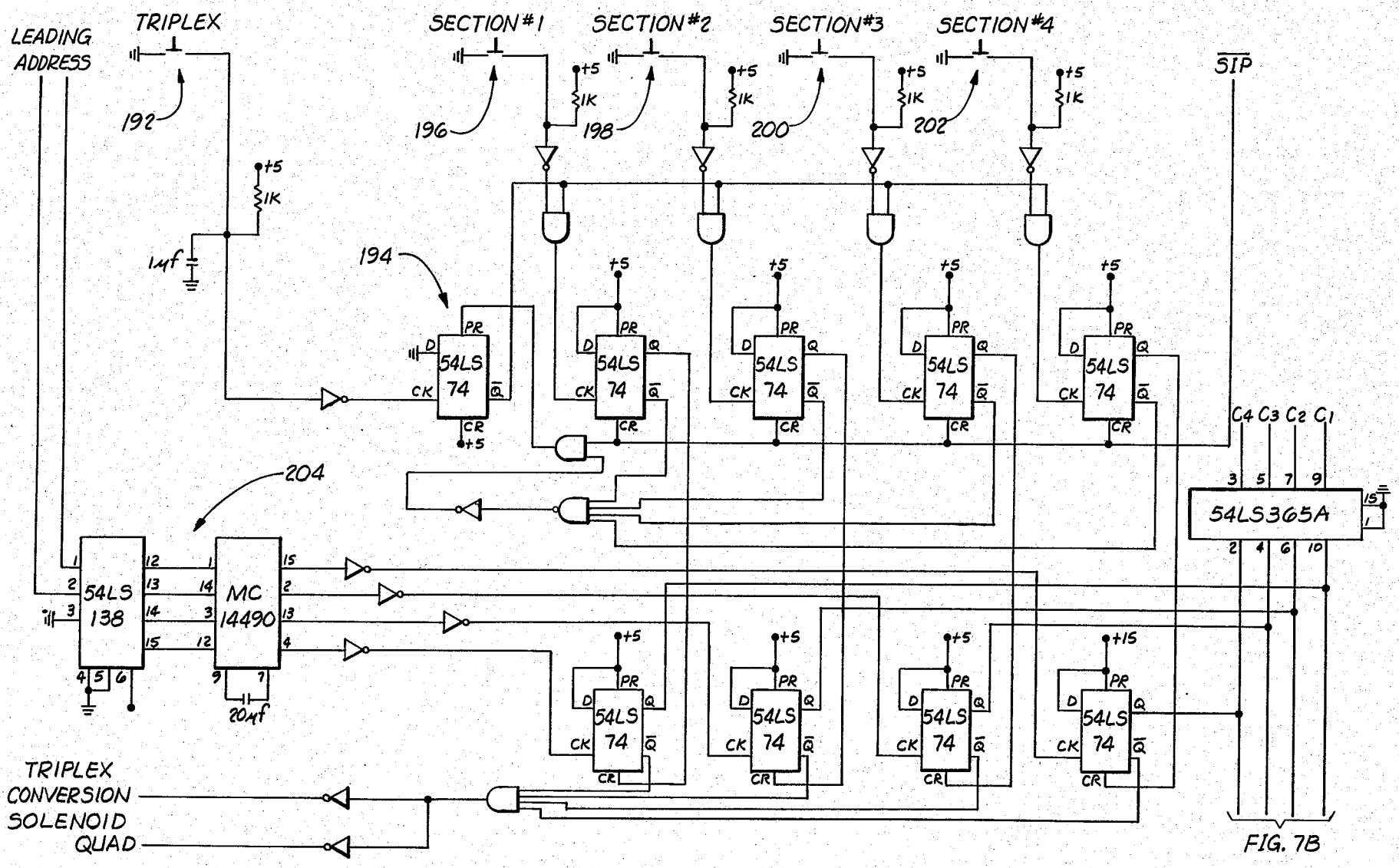
Figure 1:
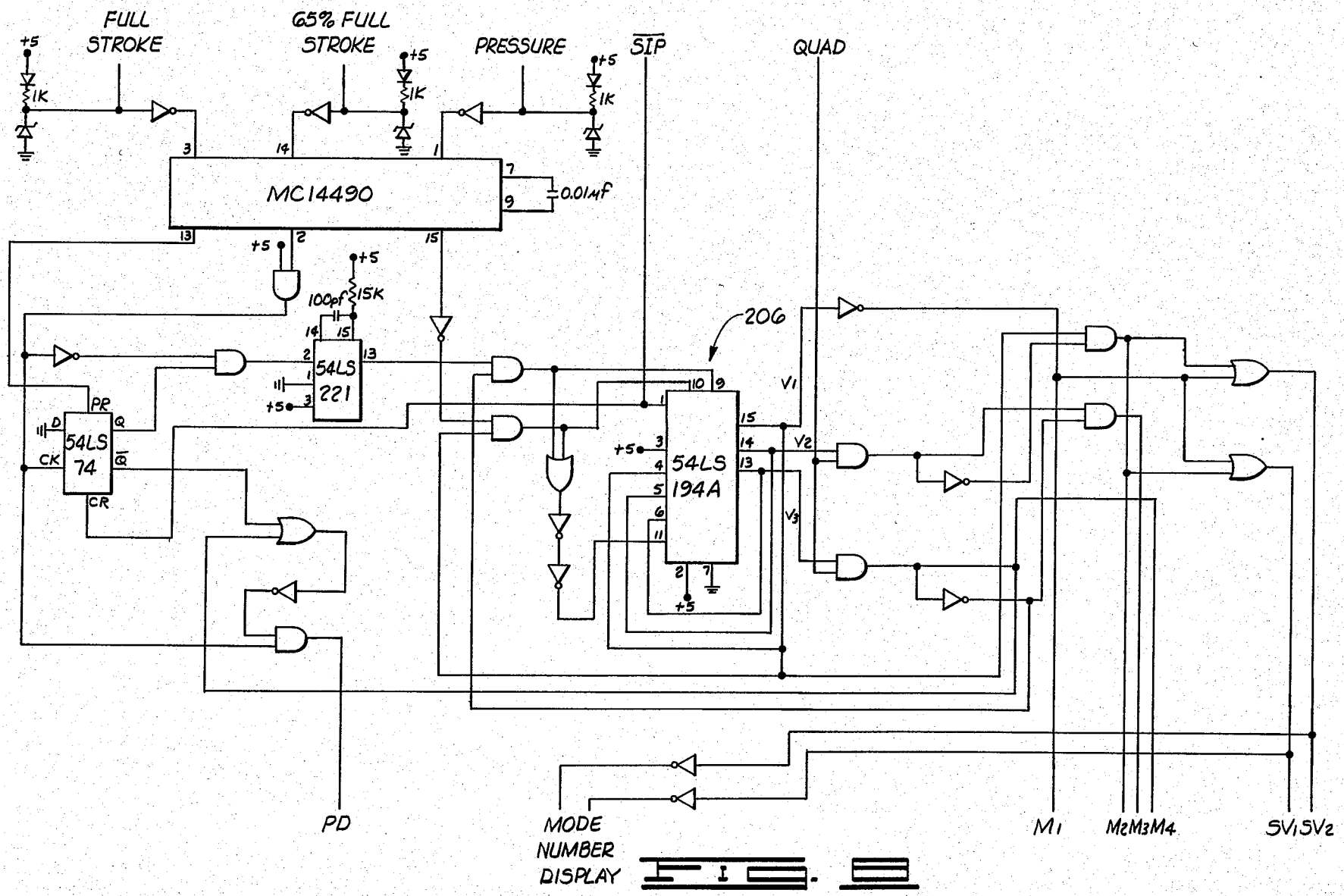
Figure 9:
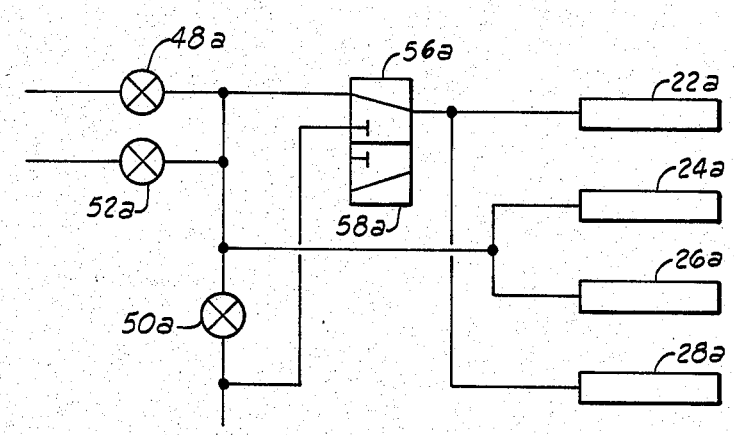

FIGS. 7A–7B disclose a schematic circuit diagram of the quadruplex-to-triplex conversion portion of the preferred embodiment control means of the present invention.

FIG. 8 discloses a schematic circuit diagram of the mode control portion of the preferred embodiment control means of the present invention.

Figure 9:
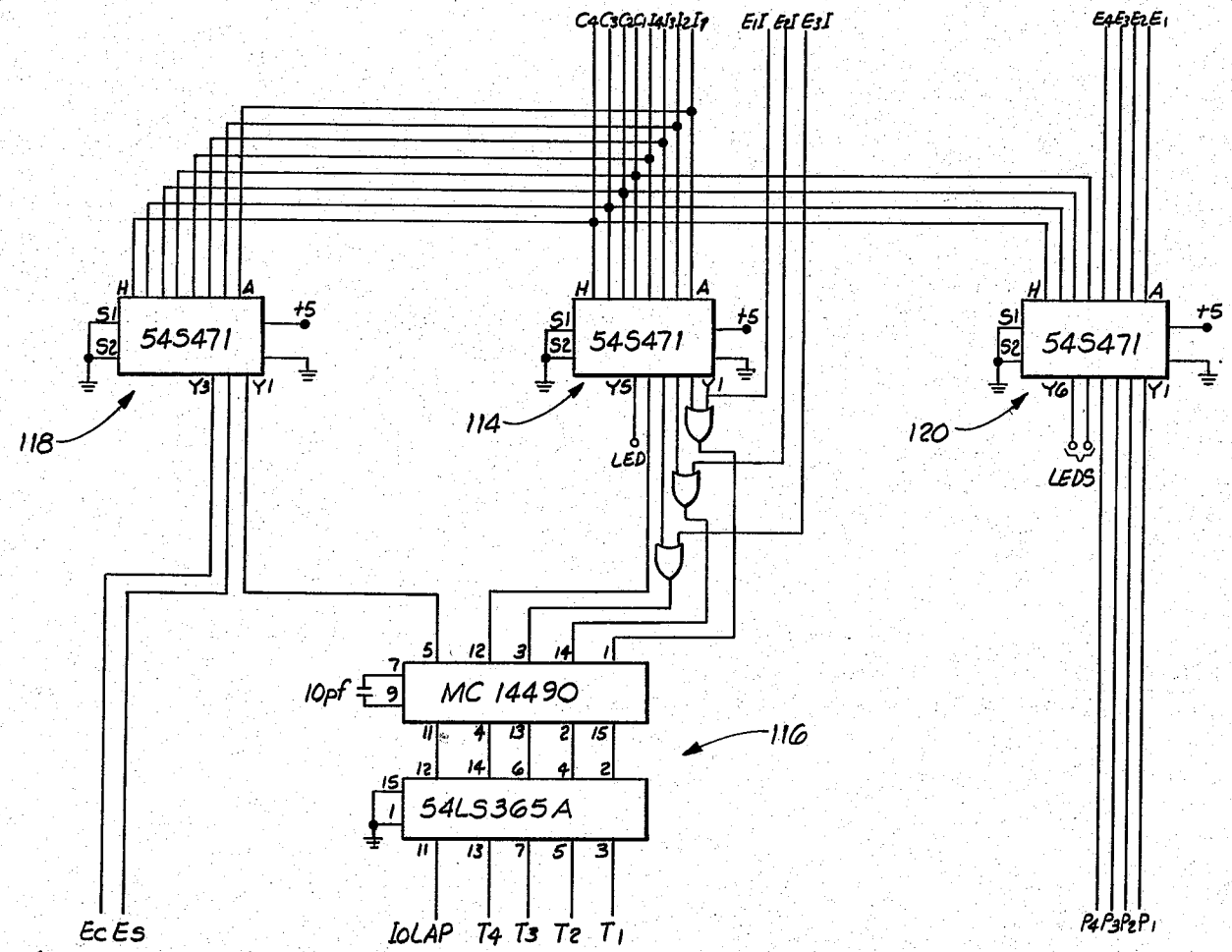
Figure 3E:
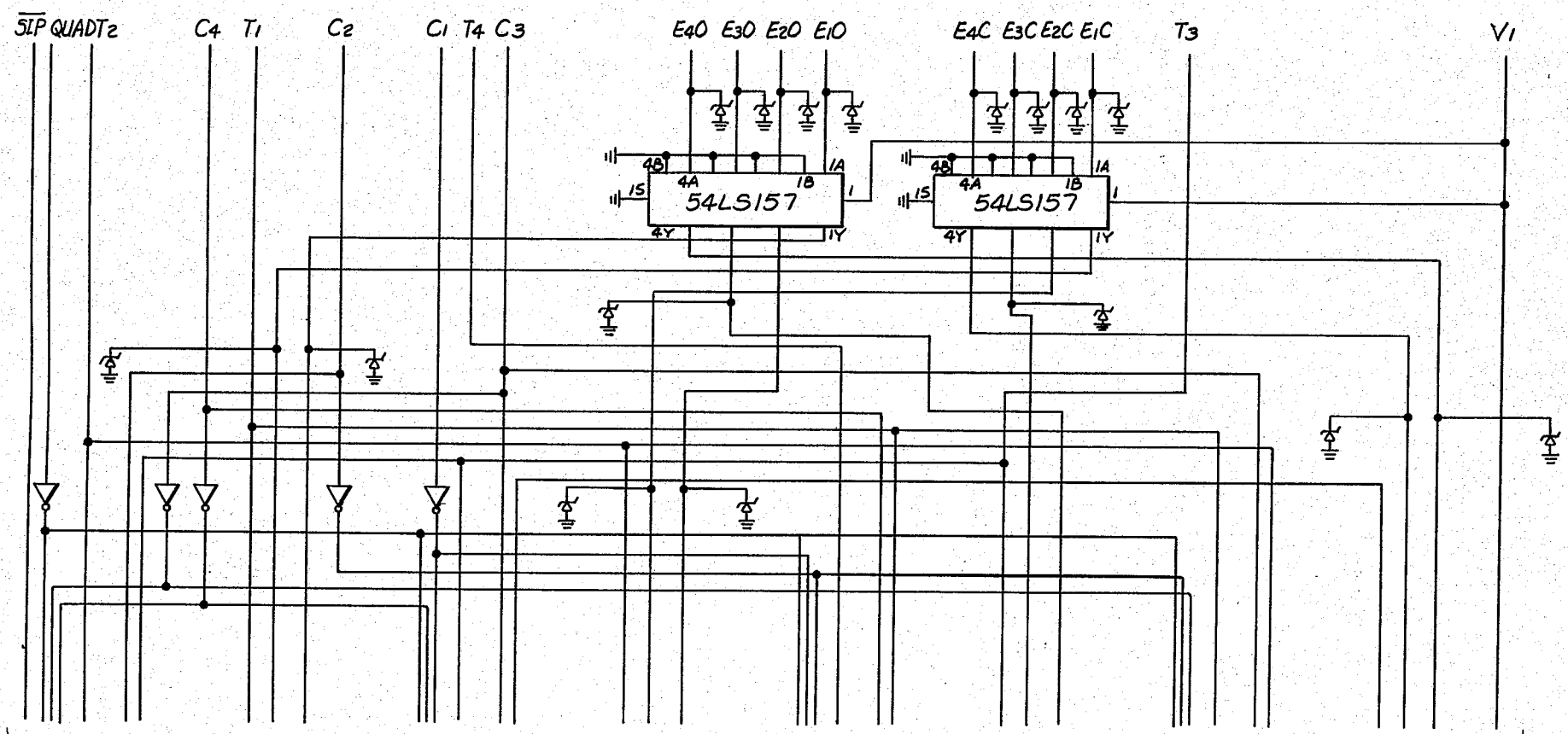
Figure 3E:
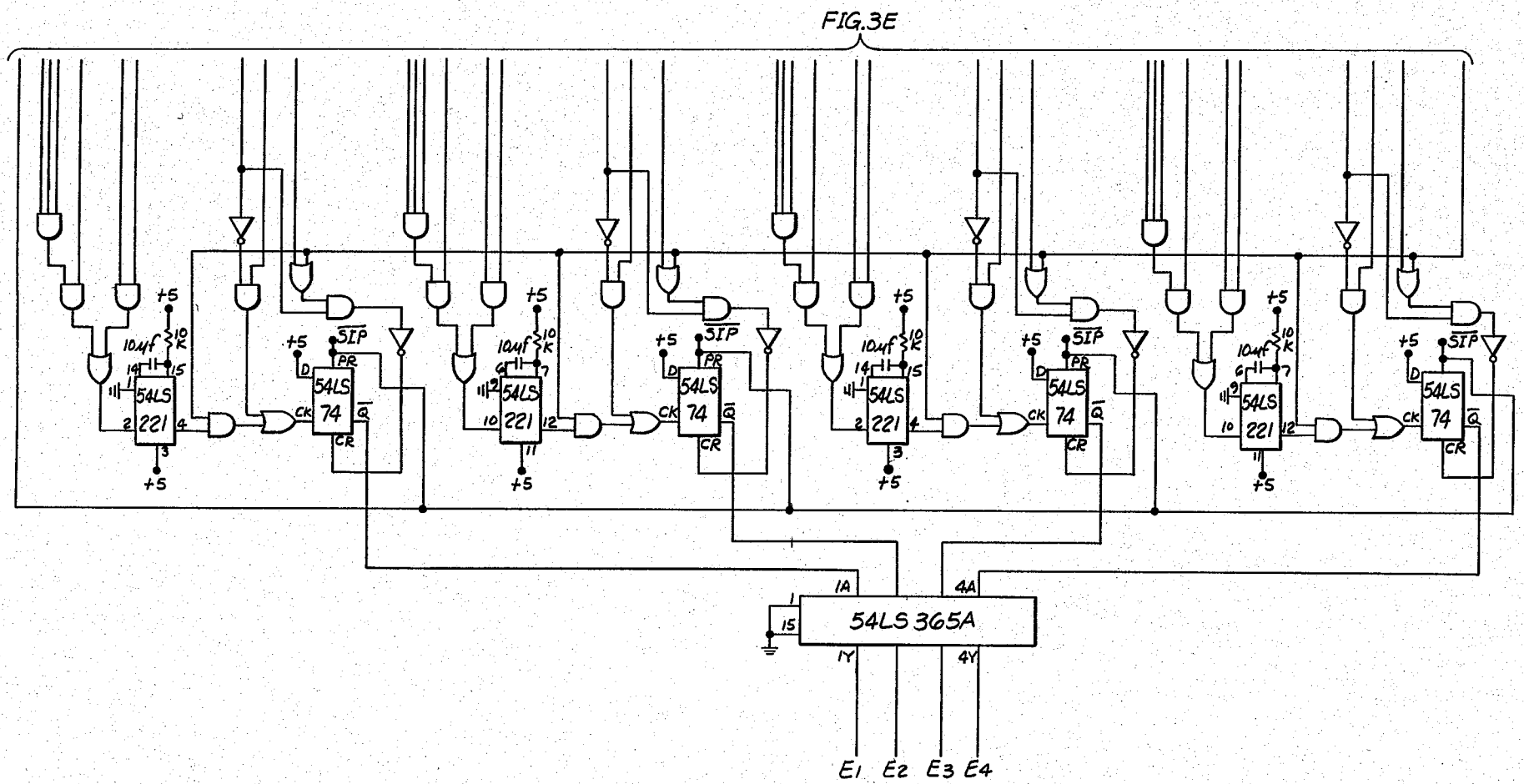

FIG. 9 discloses an example of a mode selector valve.

Figure 10:
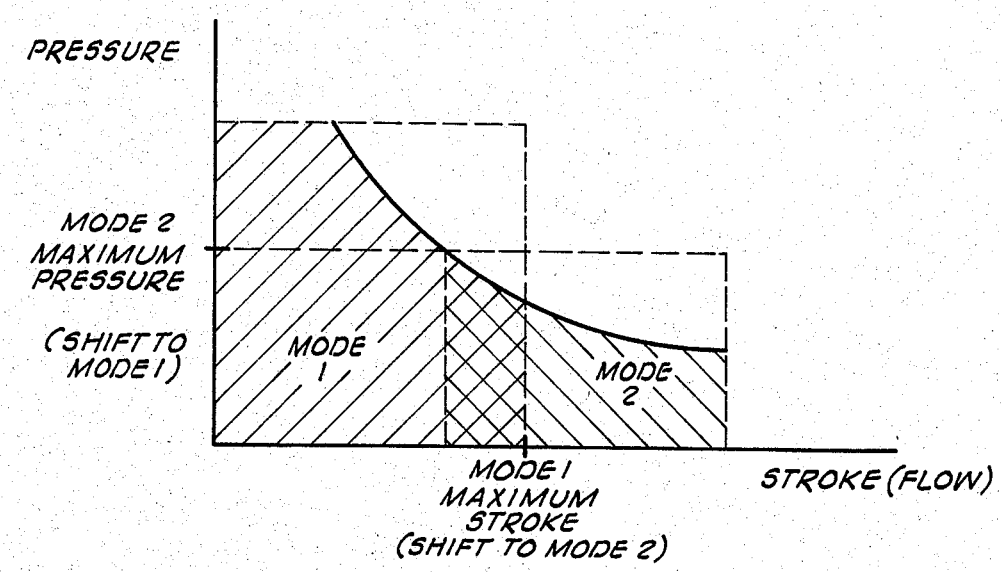

FIG. 10 discloses a pressure versus stroke diagram illustrating the ranges of the two modes of operation of the preferred embodiment.

With reference to the drawings the preferred embodiment of the present invention will be described. FIG. 1 schematically shows the preferred embodiment of an apparatus 2 constructed in accordance with the present invention. The apparatus 2 is a multiple-mode multiplex pumping apparatus hydraulically powered by a variable speed pump means 4 of a type known to the art. The hydraulic fluid used to actuate the present invention is taken from and returned to a reservoir 6 as also known to the art. The pump means 4 includes a variable-speed, positive displacement pump 8 and a pressure relief circuit having a pressure relief valve 10 of types known to the art. In one example, the pump 8 is capable of providing power up to 2,000 horsepower.

The preferred embodiment of the apparatus 2 is shown in FIG. 1 to include four pumping sections 12*a*, 12*b*, 12*c*, and 12*d* and control means 14 for controlling the operation of the four pumping sections.

The four pumping sections 12*a*, 12*b*, 12*c*, and 12*d* are similarly constructed as illustrated in FIG. 1; therefore, the elements will be described with reference to the first pumping section 12*a* only. The remaining sections' elements are designated by like numerals but followed by the letter designation of the respective section.

The first pumping section 12*a* includes a first driving portion and a first fluid communicating portion for communicating fluid from the pumping means 4 to the driving portion.

The driving portion includes a power end 16*a* and a driven portion that includes fluid end 18*a* and coupling means 20*a* for coupling the power end with the fluid end. The power end 16*a* includes piston means comprising in the preferred embodiment a plurality of cylinders 22*a*, 24*a*, 26*a*, and 28*a*, each having a piston 30*a*, 32*a*, 34*a* and 36*a*, respectively, slidably disposed therein. In the preferred embodiment illustrated in FIG. 1, each power end includes four cylinders and pistons; however, other numbers of cylinders and pistons can be used. The fluid end 18*a* includes plunger means comprising a plunger 38*a* retained in a suitable cylinder 40*a*. The plunger of the fluid end 18*a* is connected to the pistons of the power end 16*a* by the coupling means 20*a*. Each of the cylinders of the power end 16*a* has a respective end associated with the coupling means 20*a*. These ends are designated as the rod ends and each rod end is maintained by suitable means in fluid communication with each other rod end as indicated by the connections designated in FIG. 1 by the reference numerals 42*a*, 44*a*, and 46*a*. These elements and their construction are of suitable types as known to the art.

The fluid communicating portion of the first pumping section 12*a* includes inlet valve means comprising an inlet valve 48*a*, a first conduit means for communicating the inlet valve 48*a* with the cylinders 24*a* and 26*a*, and a second conduit means for communicating the inlet valve 48*a* with the cylinders 22*a* and 28*a*. The fluid communicating portion also includes exhaust valve means including an exhaust valve 50*a* disposed in suitable conduit means through which the hydraulic fluid from the cylinders 24*a* and 26*a* is exhausted via the exhaust valve 50*a* and through which the hydraulic fluid from the cylinders 22*a* and 28*a* is exhausted via mode valve means described hereinbelow. The fluid communicating portion also includes a precompression circuit means comprising a precompression inlet valve 52*a* and a precompression exhaust valve 54*a*. The fluid communicating portion also includes the aforementioned mode valve means for providing an inlet 56*a* disposed in the second conduit means of the inlet valve means between the inlet valve 48*a* and the cylinders 22*a* and 28*a*. The mode valve means also provides an outlet 58*a* for exhausting the hydraulic fluid from the cylinders 22*a* and 28*a*. The inlet 56*a* and the outlet 58*a* are embodied in the preferred embodiment by a single mode selector valve as illustrated in FIG. 9. It is to be noted that the remaining preferred embodiment pumping sections have similarly embodied mode inlets and outlets although only the one is illustrated in FIG. 9.

Each of the remaining pumping sections is similarly constructed as mentioned hereinabove. Additionally, the rod ends of the cylinders of each section are placed in fluid communication by suitable conduit means as indicated in the drawings by reference numerals 60, 62 and 64.

The control means 14 includes initialization means for placing the plunger 38*a* of the plunger means 18*a* at a first position as an initial leading discharge plunger means, for placing the plunger 38*b* of the plunger means 18*b* at a second position as an initial trailing discharge plunger means, for placing the plunger 38*c* of the plunger means 18*c* at a third position as an initial precompression plunger means, and for placing the plunger 38*d* of the plunger means 18*d* at a fourth position as an initial suction plunger means.

As designated by the path enumerated 66 in FIG. 1, the control means 14 controls the fluid communication portions of the pumping sections. In particular, the control means 14 includes inlet valve control means for controlling the positions of the first, second, third and fourth inlet valve means comprising the inlet valves 48*a*, 48*b*, 48*c*, and 48*d*. The control means also includes inlet valve detector means for detecting the positions of the first, second, third and fourth inlet valve means. The control means 14 also includes exhaust valve control means for controlling the positions of the first, second, third and fourth exhaust valve means in response to the inlet valve detector means. The control means 14 still further includes exhaust valve detector means for detecting the positions of the first, second, third and fourth exhaust valve means, specifically the positions of the exhaust valves 50*a*, 50*b*, 50*c* and 50*d*. The control means 14 also includes precompression circuit control means, responsive to the exhaust valve detector means, for controlling the first, second, third and fourth precompression circuit means comprising the precompression inlet valves 52*a*, 52*b*, 52*c* and 52*d* and the precompression exhaust valves 54*a*, 54*b*, 54*c* and 54*d*. The precompression circuit control means also includes an accumulator circuit means 68 of a type known to the art.

The control means 14 still further comprises phase control means for controlling the spacing between any of the first, second, third and fourth plunger means functioning as the leading discharge plunger means and any of the first, second, third and fourth plunger means functioning as the trailing discharge plunger means. In the preferred embodiment illustrated in FIG. 1, the phase control means includes controllable orifice means 70 controlled by the control means 14 as indicated by the dashed line enumerated 72. The controllable orifice means 70 can be replaced by suitable digitally controlled flow divider means.

The control means 14 also includes fixed stop point control means for controlling the positions at which each of the first, second, third and fourth plungers 38*a*, 38*b*, 38*c* and 38*d* stops at the end of its movement as the leading discharge plunger means. This fixed stop point control occurs independently of the speed of operation of the apparatus 2, or of the fluid being pumped thereby, or of the inlet valve response times.

The control means 14 still further includes encoder means for providing respective signals representing the actual positions of the first, second, third and fourth plungers (and their associated pistons). In the preferred embodiment the encoder means includes rotary, phase synchronous devices of the type known to the art. Each device is mechanically connected to a respective one of the coupling means 20*a*, 20*b*, 20*c*, and 20*d* as represented by the dashed lines enumerated 74*a*, 74*b*, 74*c* and 74*d*, respectively. By being mechanically connected to each of the coupling means, each encoder device generates an electrical signal proportional to the displacement of the respective coupling means as the associated plunger and pistons move.

The control means 14 still further comprises mode control means for shifting the first, second, third and fourth power end piston means between a first mode of operation and a second mode of operation in response to the pressure and stroke of the drive pump means 4 to which the apparatus 2 is connectible.

The control means 14 also includes means for operating the apparatus 2 either in quadruplex wherein all of the four pumping sections are energizable by the drive pump means 4 or in triplex wherein only three of the four pumping sections are energizable.

The control means 14 further includes means for controlling the quantity of a fluid contained in the respective rod end portions of the first, second, third and fourth power end piston means. The means for controlling the quantity of fluid, which will be more broadly referred to as the return volume control means, includes a suitable pump 76, a return volume fill valve 78, and a return volume dump valve 80 suitably connected as illustrated in FIG. 1. Control of the valves 78 and 80 is made by the control means 14 as illustrated by the dashed line enumerated 82.

The preferred embodiment of each of the aforementioned elements of the control means 14 will be more particularly described with reference to the remaining drawings.

The schematic circuit diagram of the preferred embodiment of the initialization means of the control means 14 is shown in FIGS. 2A–2E. The initialization means sets the pistons, and thus also the plungers, of the two pumping sections which are initially on discharge at the proper distance apart. The initialization means also opens and/or closes the appropriate valves and provides the control mechanisms for a cold start and warmup of the pumping apparatus 2. To accomplish this the initialization means moves the pistons in each pumping section to a respective starting position and then opens inlet valves 48*a* and 48*b* when the apparatus 2 is in condition to commence pumping. Initialization occurs when an initialization switch (not shown) is manually actuated to provide a suitable signal on the line designated in FIG. 2A by "INITIALIZE SWITCH."

Figure 2A:
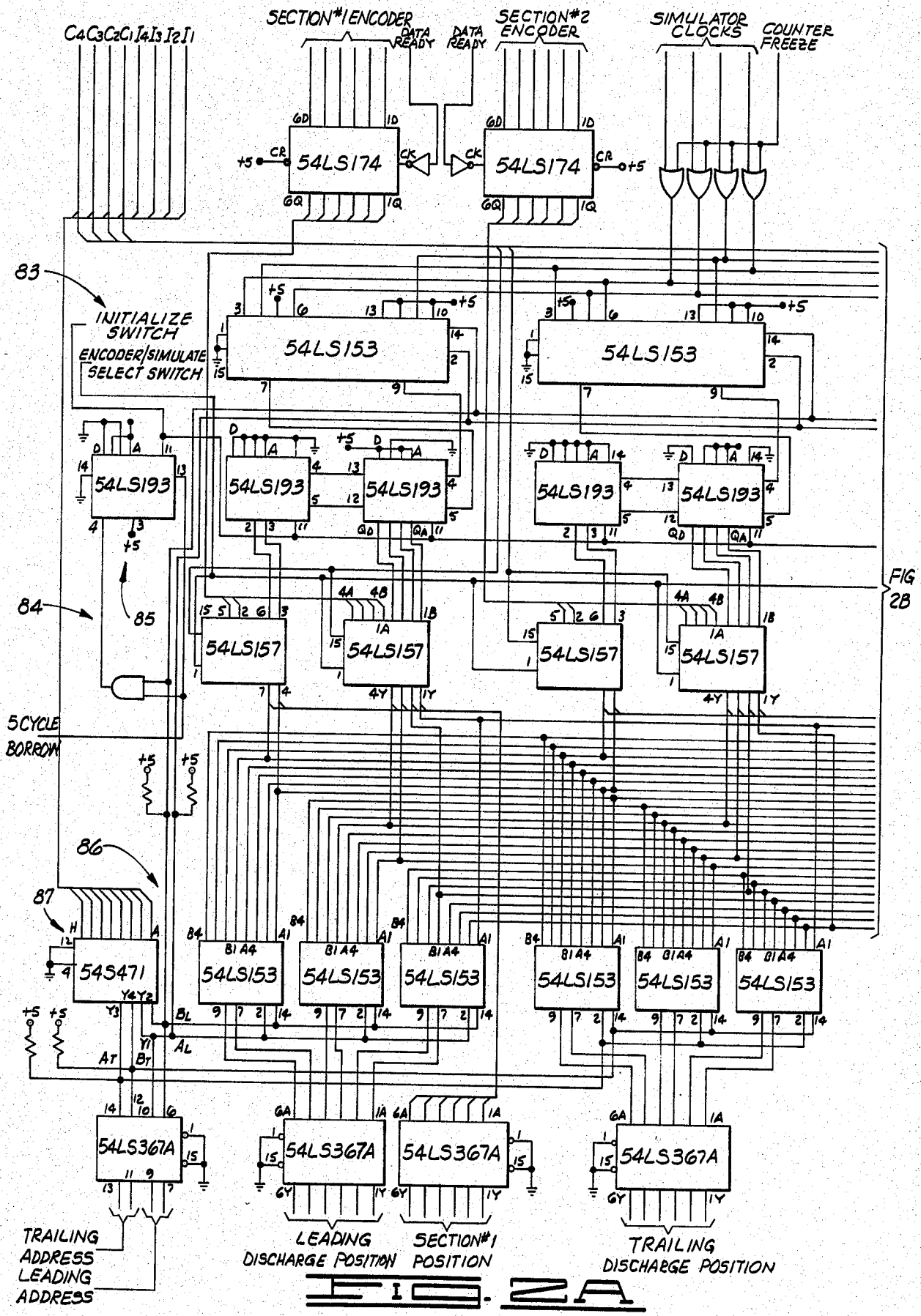
Figure 2B:
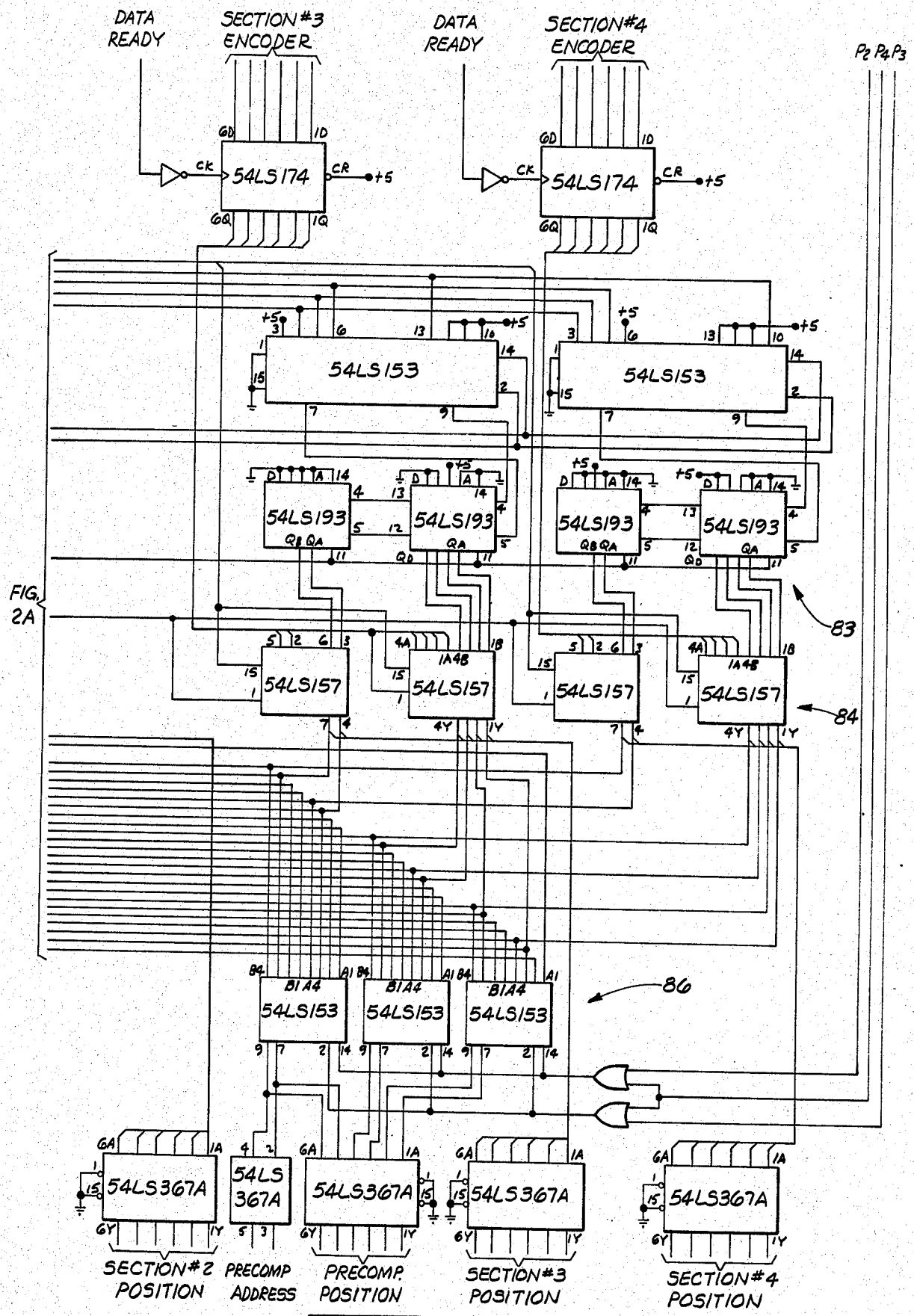

FIGS. 2A–2B disclose the portion of the initialization means which selects between simulation inputs which simulate positions of the pistons or plungers and actual inputs from the encoder means indicating the actual positions of the pistons or plungers in the pumping sections. The inputs to be used are selected by suitable actuation of an encoder/simulate select switch (not shown) as indicated in FIG. 2A. FIGS. 2A and 2B are to be examined by placing FIG. 2A to the left of FIG. 2B and aligning the appropriate interconnecting lines.

Along the top of FIGS. 2A and 2B it will be observed that there are several inputs for receiving the outputs of the encoder means indicating the detected positions of each of the pumping sections. There are also inputs designated $C_1$, $C_2$, $C_3$, and $C_4$ which are control signals indicating which of the pumping sections are active. In other words, $C_1$–$C_4$ indicate which pumping section is not used when the apparatus 2 is operated in triplex. Additional input signals are designated $I_1$, $I_2$, $I_3$, and $I_4$ which give the status of each of the inlet valves 48*a*, 48*b*, 48*c*, and 48*d*, respectively. The inputs designated $P_2$, $P_3$, $P_4$ designate the status of the precompression valves of the second, third and fourth pumping sections, respectively. The inputs designated "SIMULATOR CLOCKS" are signals from the simulator circuit shown in FIG. 2E.

The portion of the initialization means shown in FIGS. 2A–2B also includes simulation multiplex and counter circuit means 83 for receiving the simulator clock signals and converting them into the proper format for each of the respective pumping sections.

The initialization means also includes multiplex circuit means 84 for selecting either the simulation signals from the simulation multiplexer and counter circuit means 83 or the signals representing the actual positions of the pumping sections as received from the encoder means.

The portion of the initialization means shown in FIGS. 2A–2B still further includes multiplexer circuit means 86 for selecting appropriate ones of the outputs from the multiplexer circuit means 84 and thereby providing output signals designating the leading discharge pumping section position, the trailing discharge pumping section position, and the precompression pumping section position as indicated by the labeling at the bottom of FIGS. 2A–2B. Additional outputs are also indicated along the bottom of FIGS. 2A–2B.

Also shown in FIG. 2A is a five-cycle counter means 85 which also controls whether the simulation signals or the actual encoder signals are utilized. In the preferred embodiment, at the end of five cycles of the counter means 85 a five-cycle borrow signal is generated thereby to operate the apparatus 2 so that the actual encoder signals are utilized.

There is also disclosed in FIG. 2A a memory means 87 (in the preferred embodiment a programmable read only memory) which is programmed to output the addresses of the leading and trailing discharge pistons and plungers in response to the $C_1$–$C_4$ and $I_1$–$I_4$ inputs as shown in the drawing (see APPENDIX 1 for the address equations).

Figure 2C:
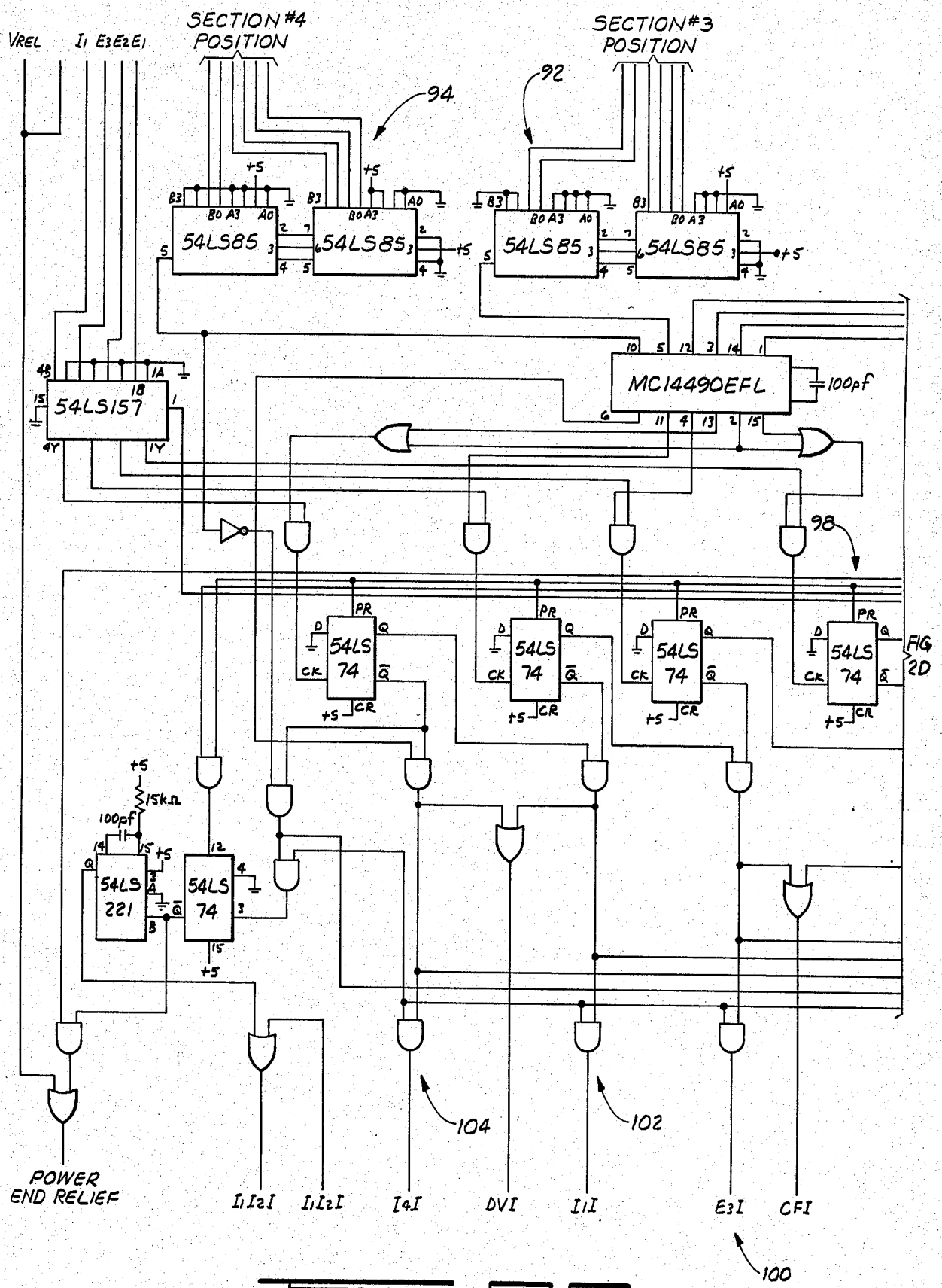
Figure 2D:
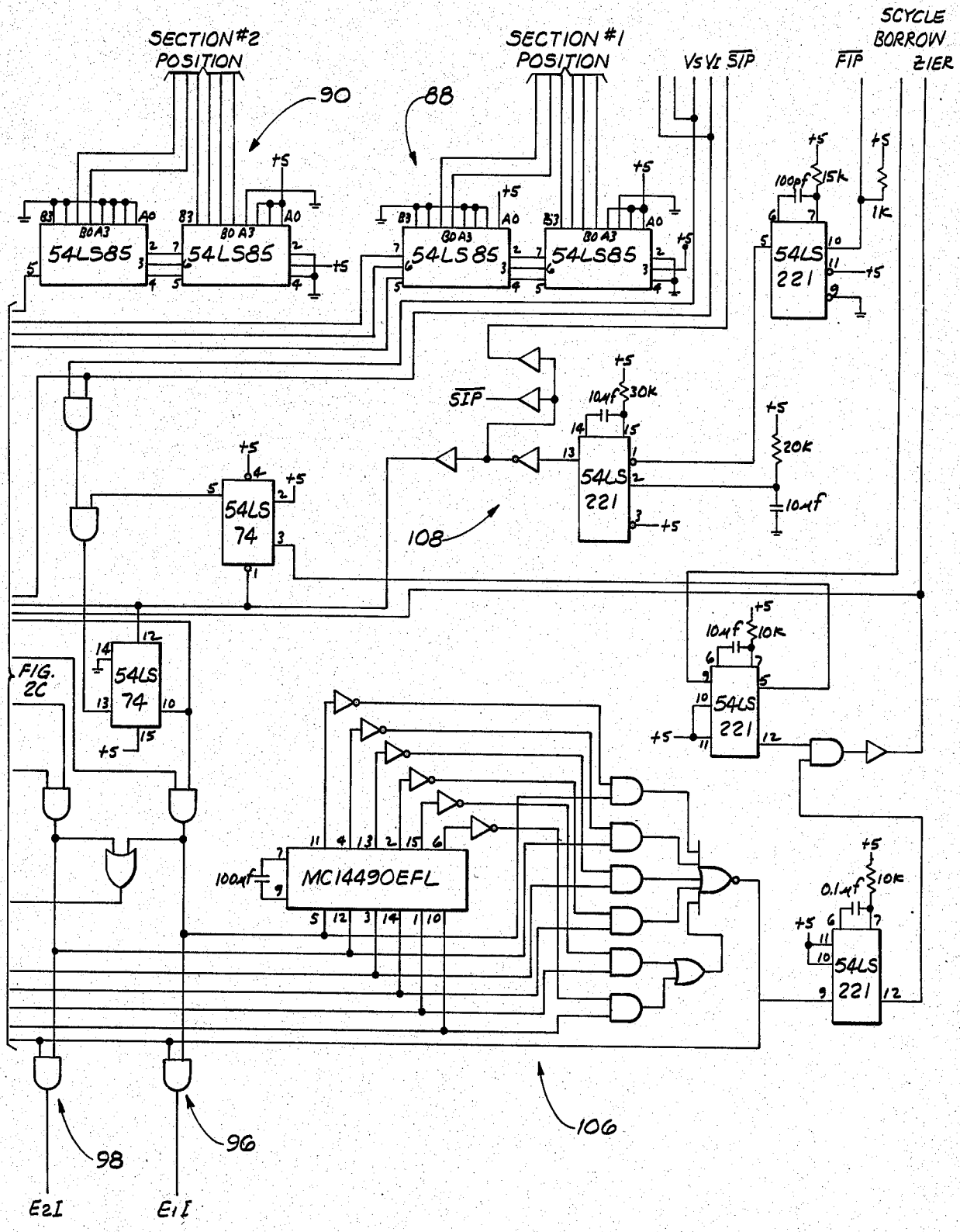

FIGS. 2C–2D disclose the schematic circuit diagram of the preferred embodiment of another portion of the initialization means. FIGS. 2C–2D are to be viewed by placing FIG. 2C to the left of FIG. 2D and aligning the specified interconnecting lines. Broadly, the circuit disclosed in FIGS. 2C–2D comprises the means for properly initially positioning the pistons and plunger of each pumping section.

The means for properly positioning the pistons and plungers of the pumping sections includes four comparator means 88, 90, 92, and 94. The first comparator means 88 compares the signal representing the position of the pistons and plunger of the first pumping section (as provided by the circuit disclosed in FIGS. 2A–2B) with a signal representing a predetermined starting position for those elements of the first pumping section. In the preferred embodiment this predetermined starting position is twenty-seven inches as established by the illustrated ground and +5 connections for the "A" inputs of the integrated circuit chips.

The second comparator means 90 compares the signal representing the position of the pistons and plunger of the second pumping section with a signal representing a predetermined starting position of these elements. In the preferred embodiment the starting position of the second pumping section is at a location less than or equal to seven inches from a reference location of the second pumping section.

The third comparator means 92 compares the signal representing the position of the pistons and plunger of the third pumping section with a signal representing a predetermined starting position thereof. In the preferred embodiment this initial starting position is less than or equal to one inch from a reference location of the third pumping section.

The fourth comparator means 94 compares the signal representing the position of the pistons and plunger of the fourth pumping section with a signal representing a predetermined starting position thereof. The predetermined starting position of the fourth pumping section is at a location greater than forty-four inches from a reference location of the fourth pumping section.

To control the flow of the hydraulic fluid into or out of the cylinders of each of the pumping sections to thereby place the pistons and plungers at their respective starting positions, the circuit shown in FIGS. 2C–2D also includes valve control circuit means. The valve control circuit means includes means 96 for opening the first exhaust valve means when the first comparator means 88 indicates the position of the pistons and plunger of the first pumping section is greater than the predetermined starting position thereof. This means 96 provides a signal designated in FIG. 2D as $E_1I$.

The valve control circuit means also includes means 98 for opening the second exhaust valve means when the second comparator means 90 indicates the position of the pistons and plunger of the second pumping section is greater than the predetermined starting position thereof. The means 98 provides a signal designated in FIG. 2D as $E_2I$.

Also included in the initialization valve control circuit means is a means 100 for opening the third exhaust valve means when the third comparator means 92 indicates the position of the pistons and plunger of the third pumping section is greater than the predetermined starting position thereof. The means 100 provides a signal designated in FIG. 2C as $E_3I$.

The valve control circuit means also includes means 102 for opening the first inlet valve means when the first comparator means 88 indicates the position of the pistons and plunger of the first pumping section is less than the predetermined starting position thereof. This means provides an output signal designated in FIG. 2C as $I_1I$.

The valve control means also provides a signal designated in FIG. 2C as $I_4I$ through the operation of a means 104 for opening the fourth inlet valve means when the fourth comparator means 94 indicates the position of the pistons and plunger of the fourth pumping section is less than the predetermined starting position thereof.

Other circuit means are provided as illustrated in FIG. 2C for generating a common fill initialization (CFI) signal and a dump valve initialization (DVI) signal. The CFI signal is a part of the control 82 for opening the fill valve 78 during initialization. The CFI signal also is used for opening a common fill valve 105 (shown in FIG. 1) so that a control pressure can be commonly applied to the inlet valve of each pumping section. The DVI signal is another part of the control 82 for opening the dump valve 80 during initialization. The DVI signal is also used to control a valve similar to the valve 105, but disposed in a common line to each of the exhaust valves, which common line is similar to the line shown in FIG. 1 extending from the valve 105 to each of the inlet valve means. This exhaust valve and line are not shown in FIG. 1, however, for purposes of simplifying the drawing. Additionally, this use of the DVI signal can be replaced by suitably changing a precompression programmable read only memory described hereinbelow. When present, the CFI and DVI signals close those inlet and exhaust valves, respectively, to which specific valve opening signals are not applied.

Once the foregoing circuit means have properly positioned the elements of each of the pumping sections, the initialization means shown in FIG. 2C provides an initialization signal to open the inlet valve means of the first and second pumping sections. This signal is designated $I_1I_2I$ in FIG. 2C.

Also shown in FIG. 2C is a POWER END RELIEF signal that is used to place the apparatus 2 in a standby state of operation by opening the pressure relief valve 10 as indicated in FIG. 1 by the dashed line designated 107. This signal can be generated by a manual switch that provides the $V_{REL}$ signal shown at the upper left of FIG. 2C. The standby state is the state in which the apparatus 2 can be placed after it has been initialized but before it is to pump a fluid, for example.

With reference to FIG. 2D, additional elements of the initialization means will be disclosed. To provide a stable signal, the valve control circuit means has associated therewith a debounce circuit means 106. Also included within the initialization means is circuit means 108 for establishing a system initialization pulse (SIP). The system initialization pulse is used as a timing control pulse.

Figure 2E:
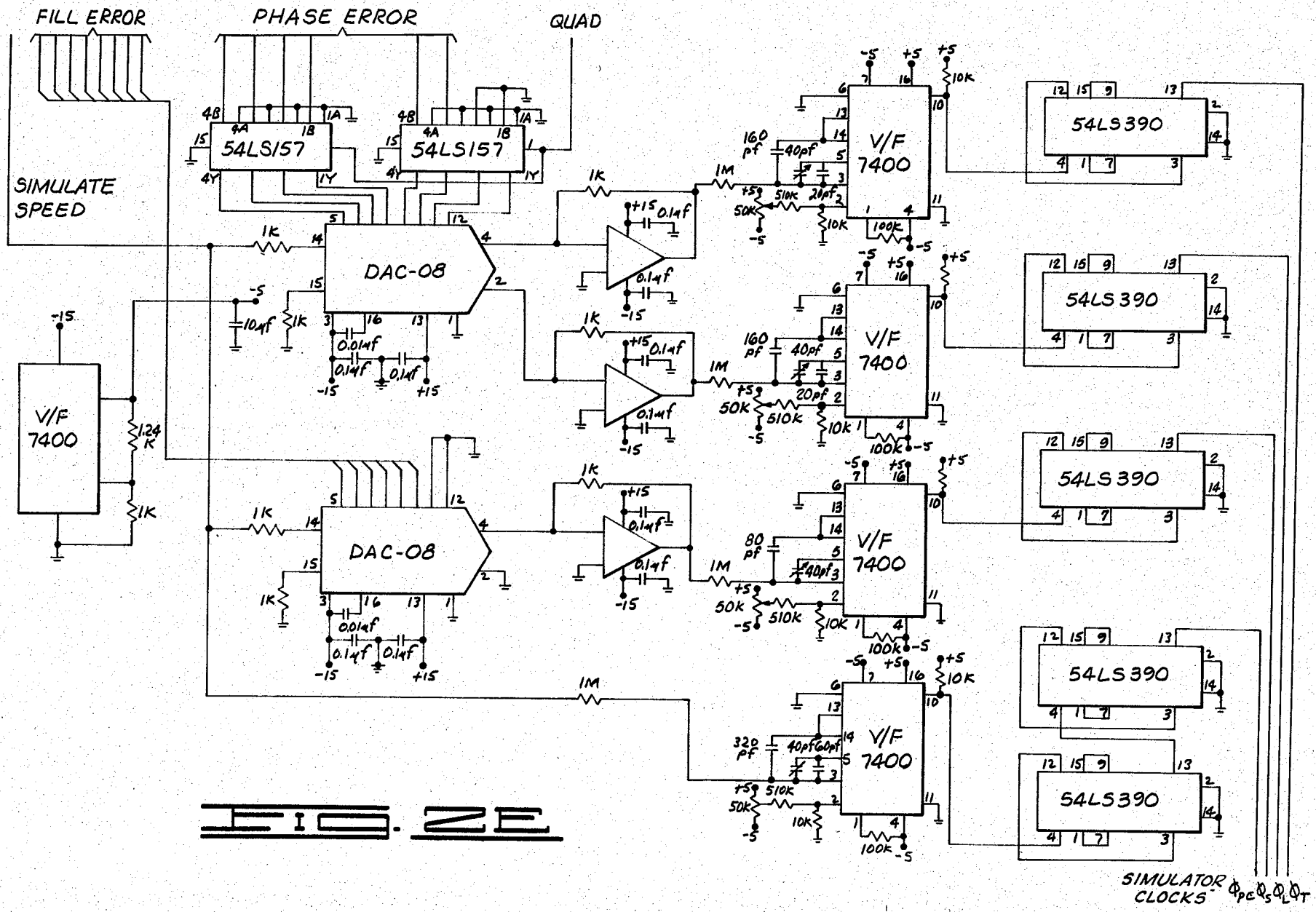
Figure 9A:
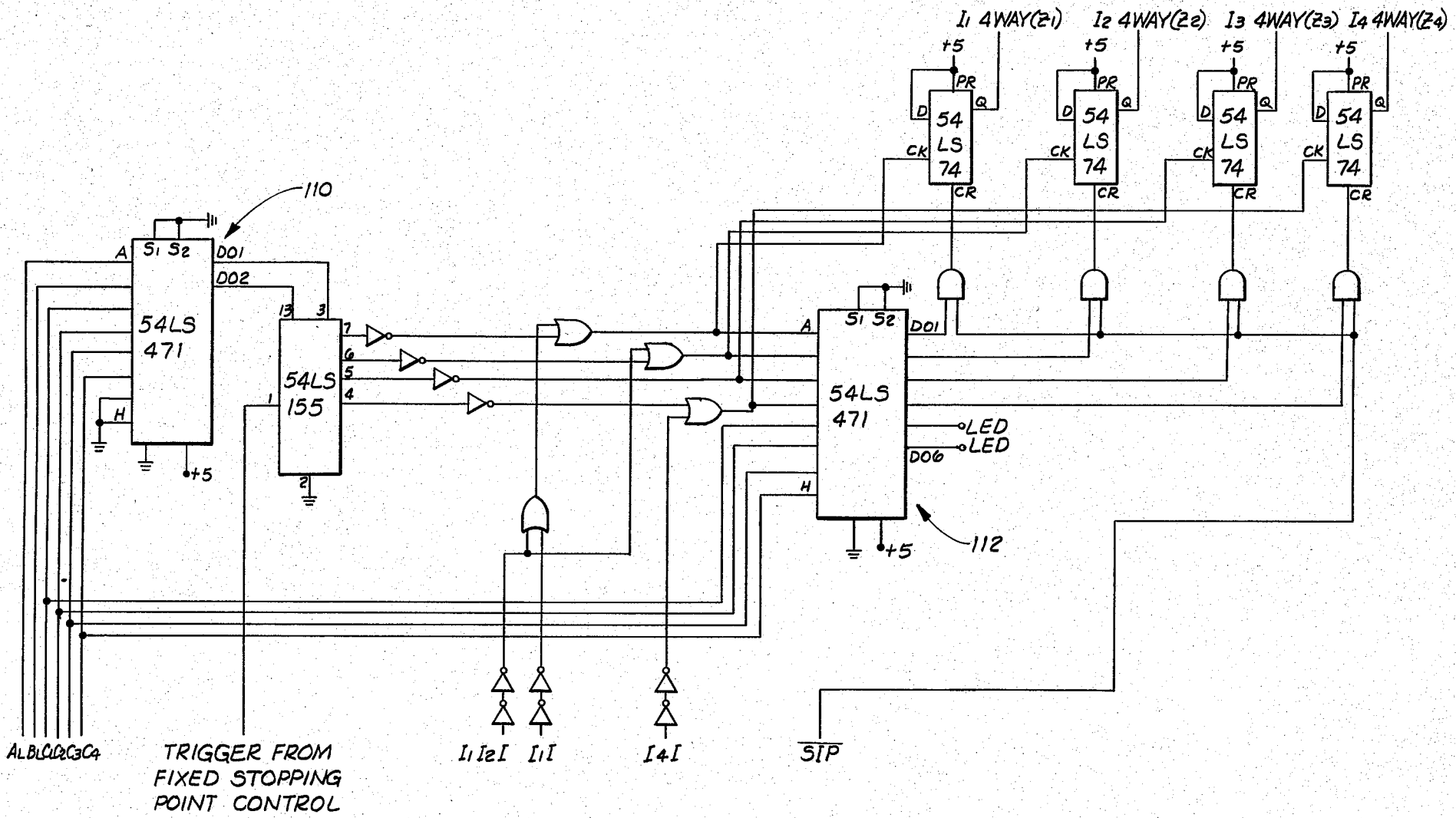

FIG. 2E discloses the portion of the initialization means which generates the simulation signals. The respective simulation signals are indicated by the precompression (PC), suction (S), leading (L), and trailing (T) subscripts. The signals simulating the leading and trailing discharging pumping sections are responsive to the reference signal designated "SIMULATE SPEED" and to the "PHASE ERROR" signal generated by the phase control means of the present invention. The signal simulating the suction pumping section is responsive to the "SIMULATE SPEED" reference signal and to the "FILL ERROR" signal used to control the volume of fluid in the rod end portions of the pumping sections. The simulation signal for the precompression pumping section is responsive only to the "SIMULATE SPEED" reference signal. The "QUAD" signal identified in FIG. 2E is a control signal designating whether the apparatus 2 is operating in quadruplex or in triplex. The "SIMULATE SPEED" signal is a manually controllable reference signal by which the pump speed can be simulated. It is generated by suitable means as known to the art.

Figure 3B:
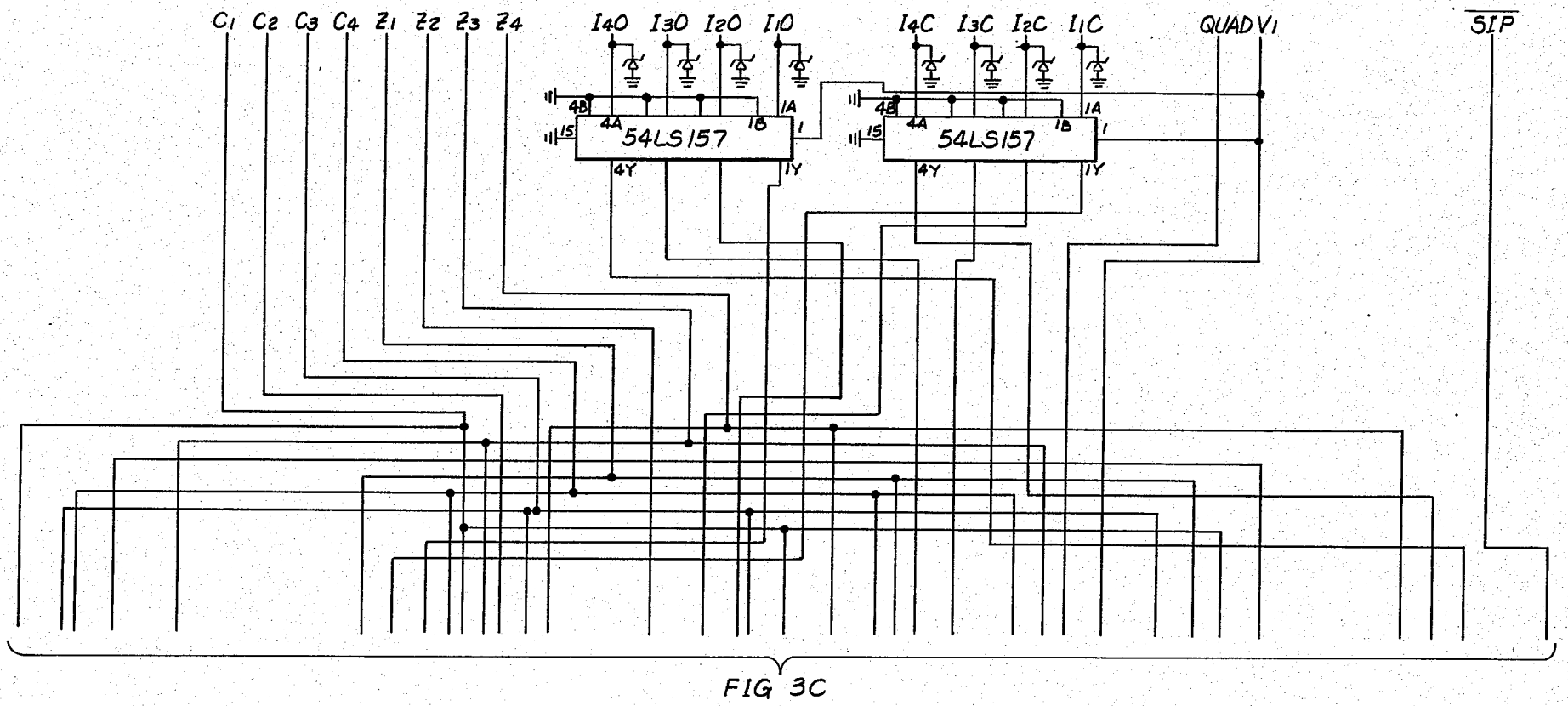

With reference to FIGS. 3A–3F the preferred embodiments of the inlet valve control means, the inlet valve detector means, the exhaust valve control means, the exhaust valve detector means, and the precompression circuit control means will be described. FIG. 3A discloses the preferred embodiment schematic circuit diagram of the inlet valve control means of the control means 14. FIG. 3A discloses a logic circuit which is responsive to the various signals shown along the bottom of the drawing. The signals designated "AL" and "BL" represent the address of the leading discharge pumping section identified in FIG. 2A as the "LEADING ADDRESS." The "TRIGGER FROM FIXED STOPPING POINT CONTROL" signal comes from the corresponding signal of the stop point control means shown in FIG. 5A.

The logic circuit shown in FIG. 3A also includes a programmable read only memory (PROM) 110 which provides the address of the next pumping section to go on discharge in response to the address of the current leading discharge pumping section and the $C_1$–$C_4$ signals (see APPENDIX 2). The logic circuit of FIG. 3A includes a second programmable read only memory 112 which resets respective ones of the inlet valve means (see APPENDIX 2).

The outputs of the inlet valve control means shown in FIG. 3A are designated "$I_1$4-WAY", "$I_2$4-WAY", "$I_3$4-WAY" and "$I_4$4-WAY." These designations indicate that these outputs go to the four-way valves comprising the specific embodiment of the inlet valves. The four-way valves are solenoid-actuated hydraulic valves which are used to actuate the specific inlet valve member. This type of valve arrangement is known to the art.

FIGS. 3B–3C disclose the inlet valve detector means of the control means 14. FIG. 3B is to be viewed by placing it at the top of FIG. 3C and aligning the interconnecting lines FIG. 3B shows the various inputs to which the inlet valve detector means is responsive. In particular, the circuit is responsive to the signals received from the inlet valve means indicating whether the valve members are open or closed. These signals are generated by magnetic pickups in the valve means as known to the art. $I_1O$–$I_4O$ indicate whether the valve means are open and $I_1C$–$I_4C$ indicate whether the valve means are closed. FIG. 3C discloses a combinational logic circuit which is used for providing either the simulation information or the actual detected inlet valve status information to the output thereof. The output of the circuit shown in FIG. 3C is the inlet valve status information designated by the signals $I_1$–$I_4$.

FIG. 3D discloses the exhaust valve control means and the precompression control means of the control means 14. The exhaust valve control means uses appropriate signals from the inlet valve detection means and generates signals $T_1$–$T_4$ to open appropriate ones of the exhaust valves when it is time for a respective one of the pumping sections to function in the suction phase of the pumping cycle. This is achieved in the preferred embodiment by means of an exhaust valve programmable read only memory means 114 which is programmed to provide the appropriate signal designating the exhaust valve to be opened in response to the $C_1$–$C_4$ and $I_1$–$I_4$ inputs shown in FIG. 3D (see APPENDIX 3). The output of the PROM 114 is logically combined with the $E_1I$, $E_2I$ and $E_3I$ initialization signals shown in FIGS. 2C–2D. The appropriately combined output signals are debounced through suitable circuit means 116 to provide the exhaust valve means control signals $T_1$–$T_4$.

Also provided at the output of the debounce and buffer circuit means 116 is the control signal IOLAP generated by the IOLAP programmable read only memory means 118 (see APPENDIX 4).

The precompression control means is responsive to exhaust valve status signals for opening the appropriate precompression valves at the appropriate time. This control is achieved by the precompression programmable read only memory means 120 in response to the status signals of the exhaust valve means designated $E_1$, $E_2$, $E_3$ and $E_4$ which are generated by the circuits shown in FIGS. 3E–3F (see APPENDIX 5). Although not shown in the preferred embodiment, a limited precompression feature known to the art can be added for, for example, limiting the distance the precompression plunger moves during slow speed pumping.

Figure 3E:
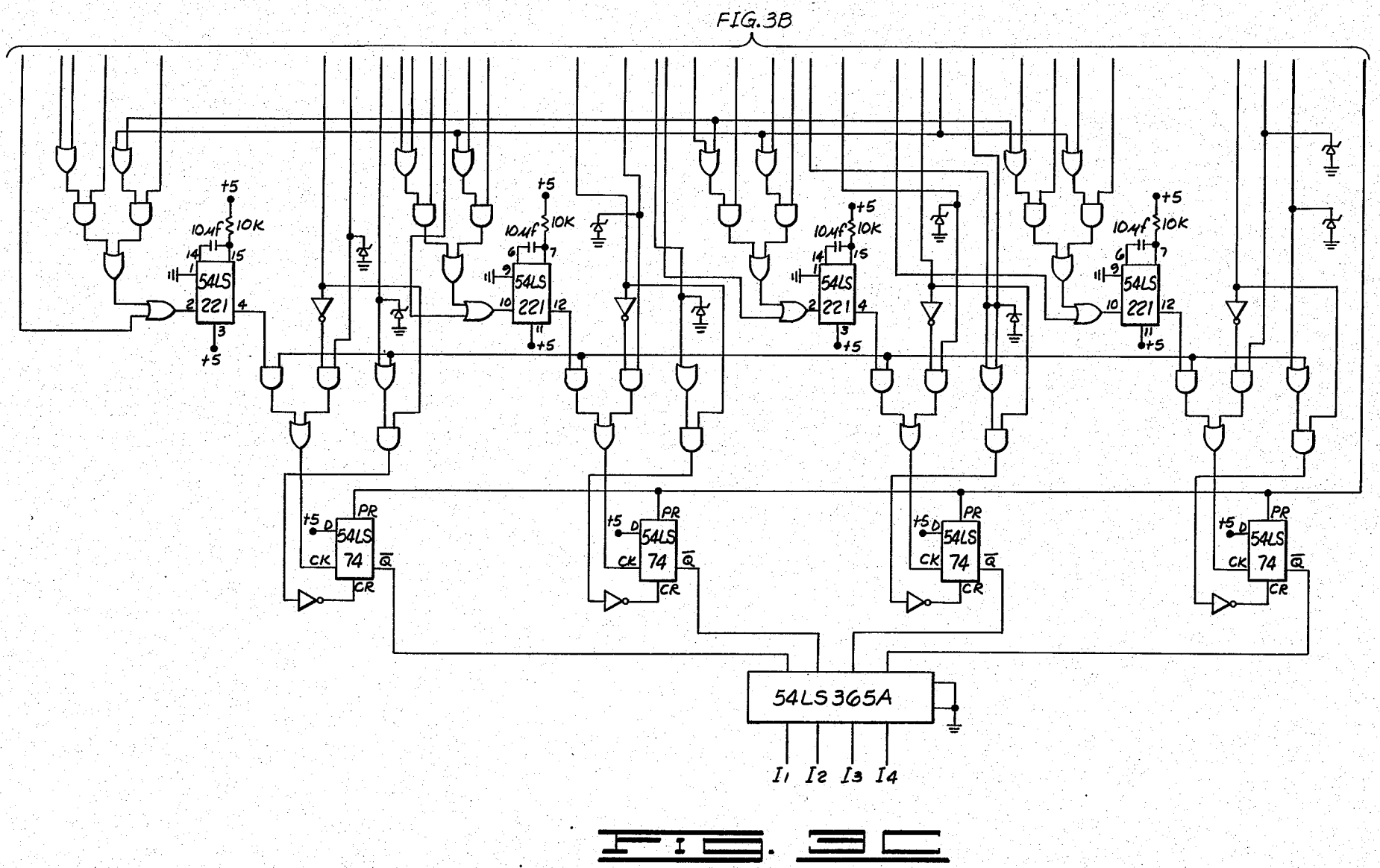

FIGS. 3E and 3F disclose the preferred embodiment schematic circuit diagram of the exhaust valve detection means. This circuit is similar to that of the inlet valve detection means shown in FIGS. 3B–3C. The signals designated $E_1O$–$E_4O$ designate the open status of the exhaust valve means and the signals $E_1C$–$E_4C$ designate the closed status of the exhaust valve means.

The preferred embodiment of the phase control means of the control means 14 is schematically illustrated in FIGS. 4A–4B. The purpose of the phase control means is to maintain a given distance between the two discharging plungers (and the associated pistons), to account for a short stroke when the pistons and plunger of the respective pumping section do not come back all the way to dead center at the end of a stroke, and to account for a varying precompression length. To accomplish this, the phase control means monitors the actual positions of the plungers and calculates the actual distance between the leading and trailing discharge plungers and compares it to a calculated desired phase difference to determine if there is a variance. If there is a variance, or phase error, correction is effected.

FIGS. 4A–4B disclose how this is accomplished in the preferred embodiment. These two figures are to be viewed by placing FIG. 4A to the right of FIG. 4B and aligning the single interconnecting line.

FIG. 4A discloses switch means 122 for manually setting or predetermined a desired maximum stroke-length through which each of the pistons and plungers of the pumping sections is to move. From this predetermined maximum stroke-length is subtracted the position of the pumping section functioning in the precompression stage of the pumping cycle. This difference is then divided by two to provide the output designated at the lower portion of FIG. 4A. This defines the phase difference to be maintained between the plunger of the pumping section functioning as the leading discharge pumping section and the plunger of the pumping section functioning as the trailing discharge pumping section. These functions are achieved by the various means shown in FIG. 4A.

In FIG. 4B it is shown that the phase control means further includes means for adding the phase difference to the detected position of the plunger of the pumping section functioning as the trailing discharge pumping section. This adding means is implemented in the preferred embodiment shown in FIG. 4B by the integrated circuit adder chips 124.

This sum is subtracted from the position of the plunger of the pumping section functioning as the leading discharge pumping section. This subtraction is achieved by inverting the output of the adder chips 124 and adding the inverted output to the detected position by means of additional integrated circuit adder chips. These elements are designated generally in FIG. 4B by the reference numeral 126. This difference defines the phase error which is provided at the outputs so labeled at the bottom of FIG. 4B. The phase error is also converted into an analog signal by a digital-to-analog converter means 128 and provided to a servomechanism which operates the variable orifice means 70 to adjust the phase between the leading and trailing discharge plungers when a phase error is indicated. As shown in FIG. 1, this adjustment occurs when the variable orifice means 70 adjusts the flow from the pump 8 through one of the variable orifice lines shown in FIG. 1 to the inlet valves 48*a*, 48*c*, and thus to the leading or trailing discharge plunger means within either the pumping section 12*a* or the pumping section 12*c*, and when it adjusts the flow from the pump 8 through the other variable orifice line shown in FIG. 1 to the inlet valves 48*b*, 48*d*, and thus to the trailing or leading discharge plunger means within either the pumping section 12*b* or the pumping section 12*d*. For example, upon initialization the plunger 38*a* is the leading discharge plunger means and the plunger 38*b* is the trailing discharge plunger means; therefore, an adjustment in the flow through the two variable orifice lines will cause an adjustment in the phase relationship between the plunger 38*a*, which is connected to the one variable orifice line through the inlet valve 48*a*, and the plunger 38*b*, which is connected to the other variable orifice line through the inlet valve 48*b*. As the pumping cycle continues, the plunger 38*b* becomes the leading discharge plunger means and the plunger 38*c*, initially the precompression plunger means, becomes the trailing discharge plunger means; however, phase control is still maintained via the variable orifice means 70 because the plunger 38*c* is connected through the inlet valve 48*c* to the same variable orifice line as the plunger 38*a*, which line is different from the line to which the then-leading plunger 38*b* is connected through the inlet valve 48*b*. Likewise, when the plunger 38*c* becomes the leading discharge plunger means and the plunger 38*d* becomes the trailing discharge plunger means, the phase between these two plungers is controlled via the variable orifice means 70 because these two plungers are likewise connected to different ones of the two variable orifice lines as shown in FIG. 1. When the plunger 38*d* becomes the leading discharge means and the plunger 38*a* becomes the trailing discharge means, the phase control is similarly maintained because the two plungers are connected to respective ones of the different variable orifice lines. It is contemplated that the variable orifice means 70 can be replaced by suitable digitally controlled orifices. The digital-to-analog converter means 128 and its associated circuitry provides a means for correcting the position of the trailing discharge plunger means in response to the calculated phase error.

FIGS. 5A–5C disclose the schematic circuit diagram for the preferred embodiment of the stop point control means of the control means 14. These figures are to be examined by placing FIG. 5A to the left of FIG. 5B and by placing FIG. 5C to the right of FIG. 5B. The stop point control means maintains a constant discharge stroke length independent of the inlet valve response and/or pump speed. This is achieved by measuring the inlet valve closing time of the respective inlet valve and the distance which the associated pistons and/or plunger of the respective pumping section move during the closing time and then by calculating the trigger point for the pistons and/or plunger at which the inlet valve must be signaled to close to insure that the pistons and/or plunger stop at the fixed stopping point.

The stop point control means includes means for determining a wait time of any one of the inlet valve means. In the preferred embodiment as shown in FIGS. 5A–5C the wait time determining means includes means for determining a duration from the time of an actuation of the solenoid of the aforementioned four-way inlet valves to the time at which the valve member of the inlet valve is moved to the closed position thereof. This valve closure time determining means includes the integrated circuit timer means 130 as shown in FIG. 5A.

The wait time determining means also includes means for dividing the duration of the valve closure time by two thereby defining a quotient. This division is effected by the integrated circuit storage means 132 and the output thereof. This quotient is provided to the inputs of integrated circuit adder chips 134 shown in FIG. 5B.

Also provided to the inputs of the integrated circuit adder chips 134 are signals from a manual switch means 136 by which a predetermined solenoid response time can be manually entered. The amount entered in the switch means 136 represents one-half of the full solenoid response time so that when it is added to the output of the storage means 132 a sum representing the total solenoid response time and one-half of the movement time of the inlet valve member is provided at the output of the integrated circuit adder chips 134. The output of the integrated circuit adder chips 134 is the wait time.

Only one-half the actual detected movement time of the inlet valve member is used because it is assumed that the plunger of the corresponding pumping section decelerates linearly from the time the inlet valve member actually commences movement to its closed position; therefore, while the plunger is moving at a constant speed, one needs to measure only displacement over one-half a period of time to determine how far the plunger will move as it comes to rest over the entire closure time of the inlet valve means. The solenoid response time is the time from actuation (i.e., energization or deenergization) of the solenoid to first movement of the valve member within the inlet valve.

The wait time is loaded into a counter means 138 which is counted down by a clocking signal provided by a time means 140 shown in FIG. 5A.

The stop point control means also includes means for calculating the distance which the corresponding plunger of the pumping section associated with the respective inlet valve means moves during the wait time. This distance calculating means is implemented by the integrated circuits shown in FIG. 5C. The position of the trailing discharge pumping section is entered into an integrated circuit latch means 142 at the start of the wait time. At the end of the wait time, the changed position of the trailing discharge pumping section is entered into another integrated circuit latch means 144. The difference between these two positions is provided at the output of the integrated circuit adder chips 146. This output is inverted and provided to integrated circuit adder chips 148 for subtraction from the predetermined maximum stroke-length entered in the switch means 122 shown in FIG. 4A. This difference between the predetermined maximum stroke-length and the distance which the plunger of the pumping section travels during the corresponding inlet valve means wait time defines the trigger point at which the corresponding inlet valve means is to be actuated to close. In other words, when the plunger of the corresponding pumping section reaches the trigger point, the solenoid of the corresponding inlet valve means is actuated thereby commencing the valve closure operation. At the end of the valve closure period, the pumping section plunger will be stopped at the fixed point. This trigger point control is achieved by the comparison means and related circuit means 150 shown in FIG. 5A. When the circuit means 150 detects that the corresponding pumping section has reached the trigger point, it actuates an integrated circuit 152 to provide the "TRIGGER TO INLET VALVE CONTROL CIRCUIT" for activating the inlet valve control means.

The preferred embodiment of the return volume control means of the control means 14 is schematically illustrated in FIGS. 6A–6D. These drawings are to be reviewed by placing FIGS. 6A and 6D to the right of FIG. 6B and by placing FIG. 6C to the left of FIG. 6B and by associating the respective interconnecting lines as designated in the drawings. The return volume control means of the preferred embodiment controls the volume of fluid in the rod end portions of the cylinders of the pumping sections so that the pistons of the pumping section functioning in the suction phase of the pumping cycle are always properly returned. The preferred embodiment of the return volume control means automatically adjusts the volume for different treating fluids being pumped and for different pump speeds. These features of the return volume control means are achieved in the preferred embodiment by means for computing the required rod end volume for the fluid being pumped and for the operating speed, by means for calculating the actual volume, and by means for subtracting the two calculated volumes to determine if more or less fluid is needed in the rod end portions.

Figure 6:
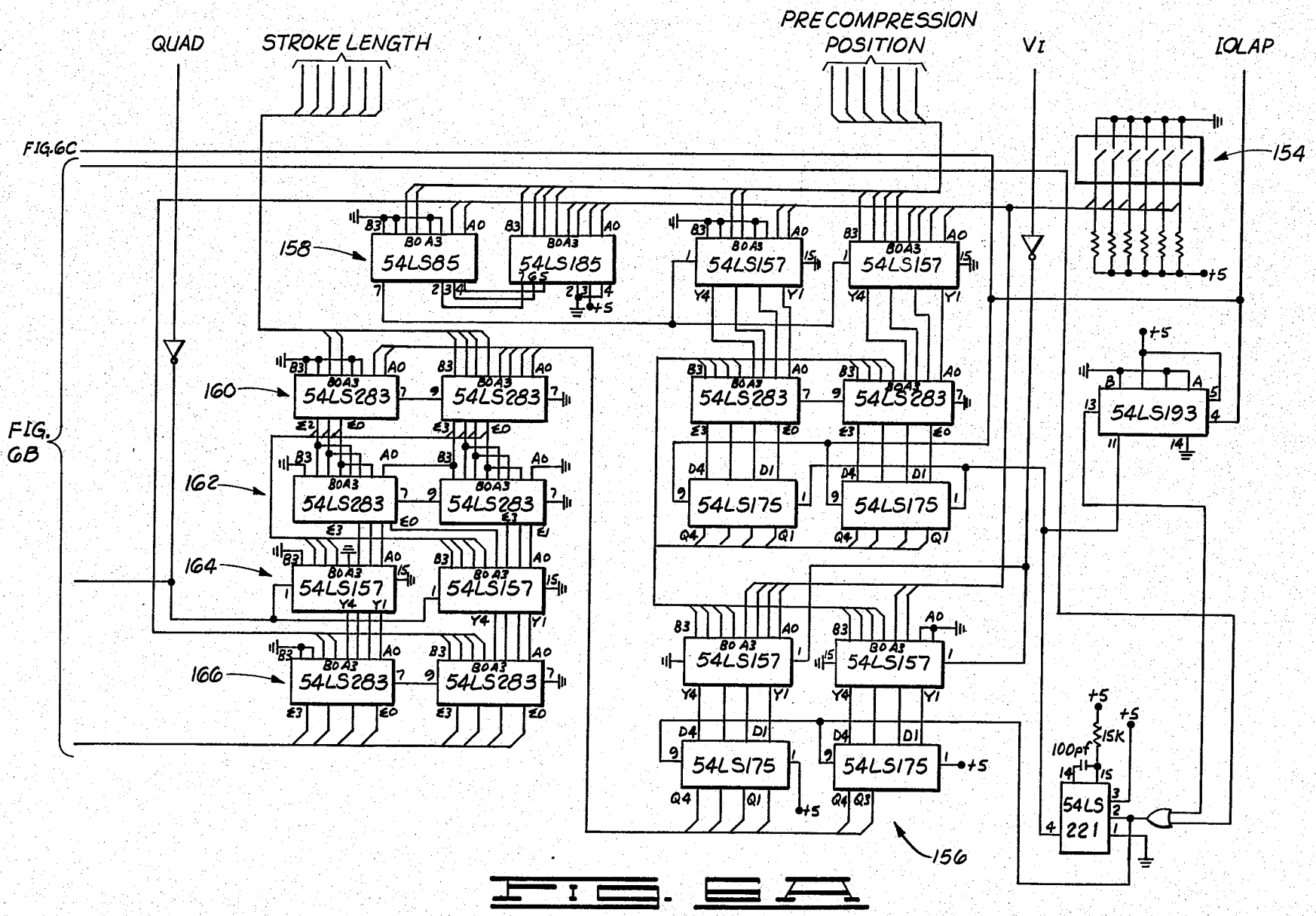
Figure 6B:
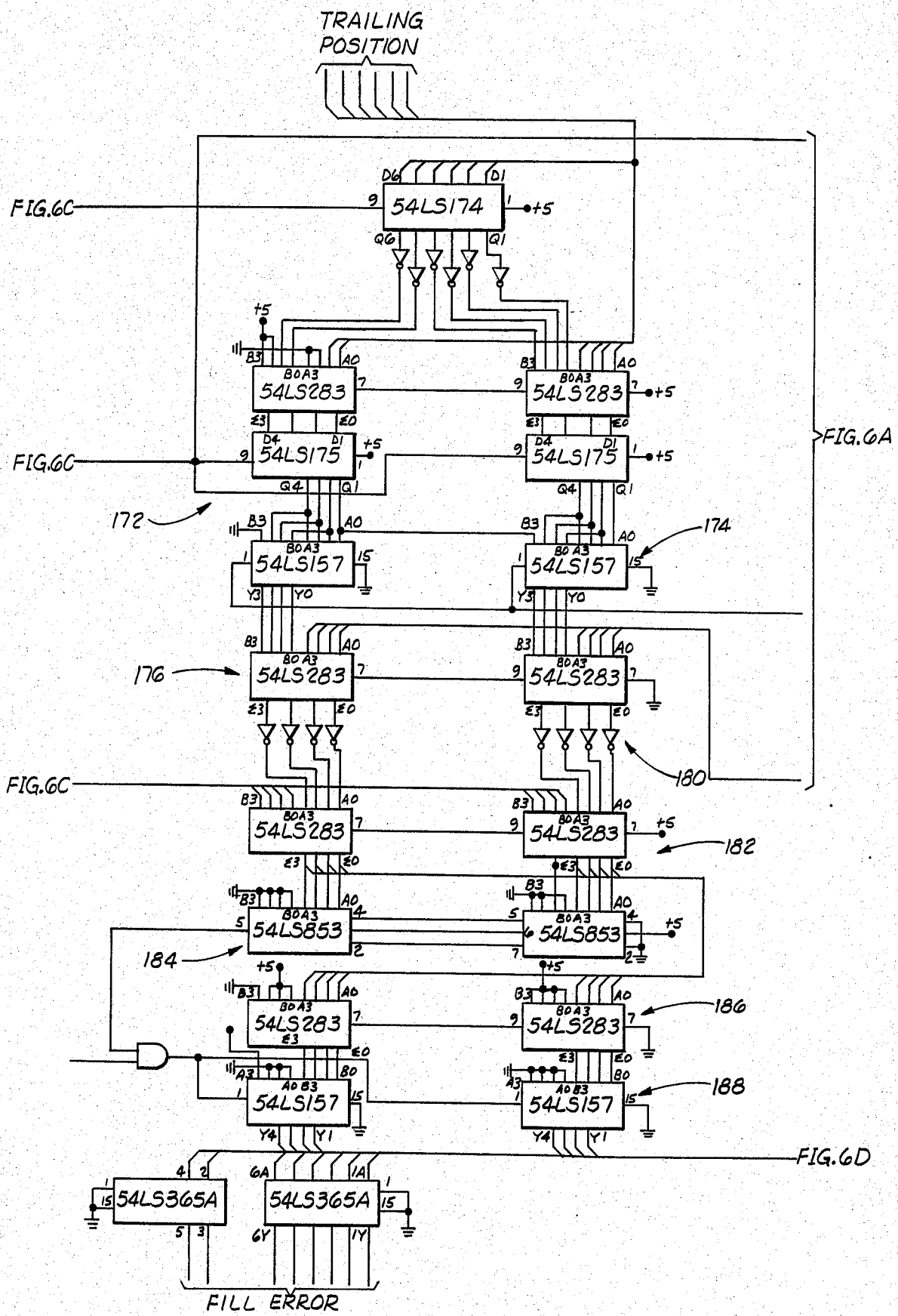
Figure 6C:
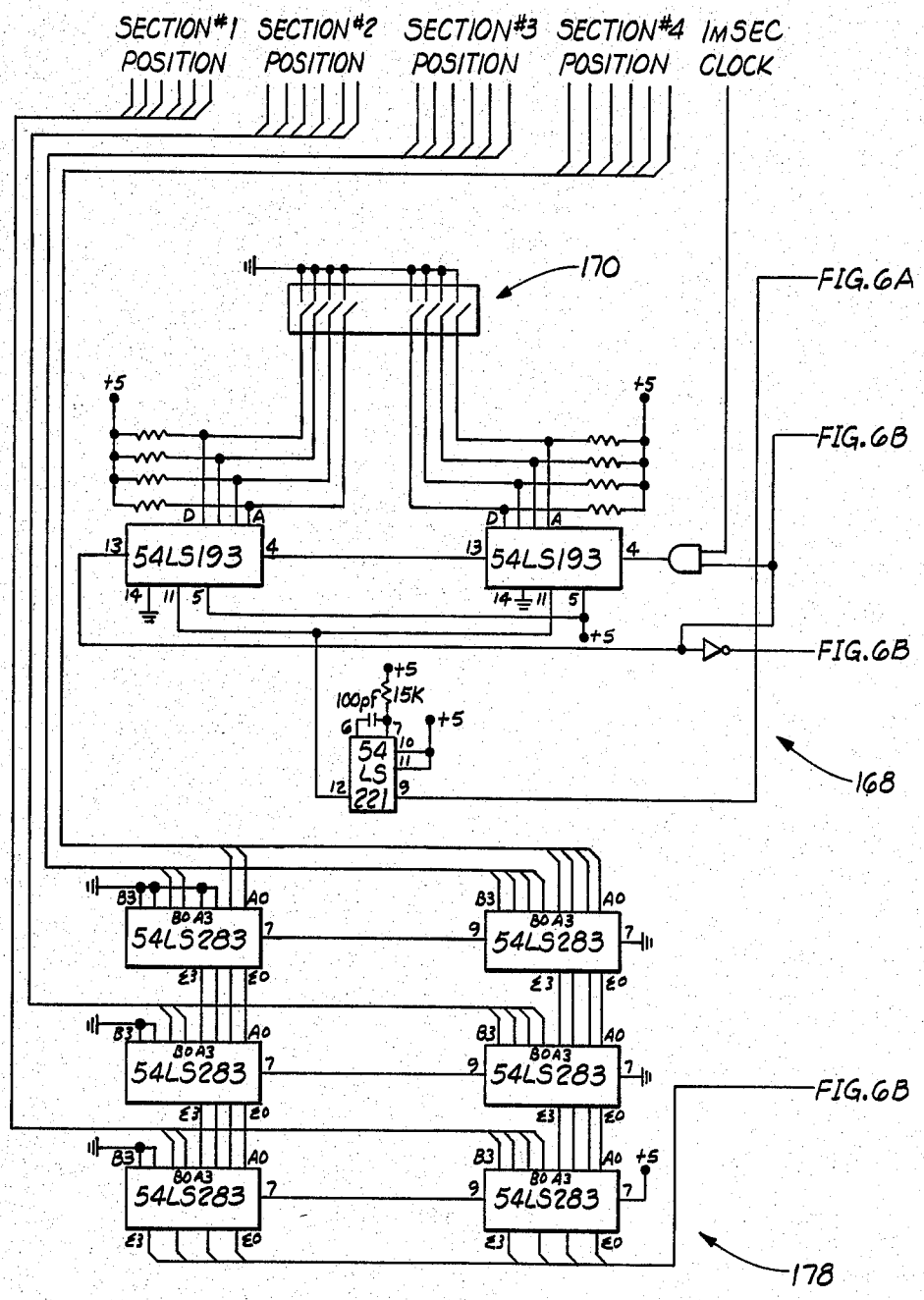
Figure 6B:
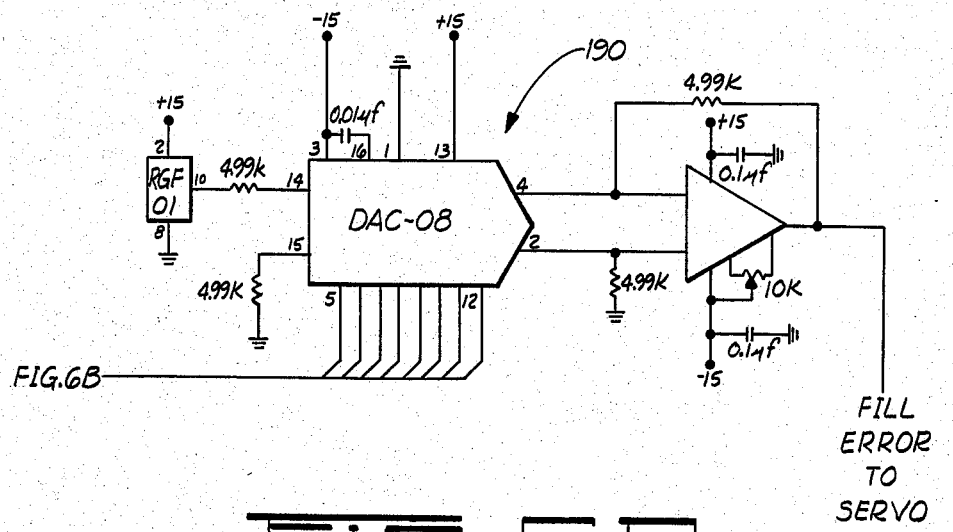

FIG. 6A and the upper portions of FIGS. 6B and 6C disclose the schematic circuit diagram of the preferred embodiment of the means for computing a required quantity which is proportional to the volume of fluid required in respective end portions of the first, second, third and fourth power end piston means of the pumping sections. The required quantity computing means includes a switch means 154 for manually entering a predetermined minimum precompression set point. The selected minimum precompression set point is provided as a default to prevent the plungers and/or pistons from hitting a mechanical stop (such as the end of the cylinders in which the plungers and pistons are housed) during the suction stroke.

The required quantity computing means also includes an integrated circuit means 156 for calculating the sum of four actual precompression positions or the sum of four predetermined precompression set points. Which one of these two sums is calculated is determined by a comparator means 158 which compares the actual detected precompression position with the predetermined minimum precompression set point. Whichever sum is selected by the comparator means 158, the uppermost six bits are provided to integrated circuit adder chips 160 whereby the output of the integrated circuit means 156 is effectively divided by four to provide an average precompression length.

The average precompression length is added to the predetermined stroke length by the adder chips 160. The output of the adder chips 160 is appropriately provided to the inputs of integrated circuit adder chips 162 which provide means for multiplying the sum of the average precompression length and the predetermined stroke-length by 1.5.

Both the sum from the adder chips 160 and the effective product provided by the output of the adder chips 162 are provided to respective channels of integrated circuit multiplexer chips 164. The multiplexer chips 164 are controlled by the "QUAD" signal to select either the sum of the adder chips 160 if the apparatus 2 is operating in triplex or the product of the adder chips 162 if the apparatus 2 is operating in quadruplex. The selected output is provided to integrated circuit adder chips 166 for addition thereby to the predetermined minimum precompression set point. This sum is provided to the circuitry shown in FIG. 6B.

FIG. 6B shows that the required quantity computing means also includes means for determining the change in the position of the one of the first, second, third or fourth pumping sections functioning as the trailing pumping section over a predetermined period of time. The predetermined period of time is provided by the circuitry disclosed in the upper portion of FIG. 6C and designated by the reference numeral 168. The time period is controlled by a switch means 170 for manually receiving a predetermined time setting representative of the response times of the inlet and exhaust valves. The timing signal provided by the circuit 168 controls the operation of an integrated circuit means 172 which is the preferred embodiment of the means for determining the change in the position of the trailing discharge pumping section. The distance the trailing discharge pumping section travels is added to the output of the adder chips 166 if the apparatus 2 is operating in quadruplex or is divided by two and then added to the output of the adder chips 166 if the apparatus 2 is operating in triplex. This is achieved by means of the integrated circuit multiplexer chips 174 shown in FIG. 6B.

The addition of the outputs from the multiplexer chips 174 and the adder chips 166 is effected by the integrated circuit adder chips 176. The output of the adder chips 176 establishes the sum representing the required volume needed in the rod end portions of the pumping sections.

The return volume control means also includes means for calculating an actual quantity proportional to the actual volume of fluid contained in the respective end portions of the first, second, third and fourth power end piston means of the four pumping sections. This means includes means for adding all the detected positions of the four pumping sections to establish a sum of actual volume. This sum is calculated by means of the integrated circuit adder chips 178 shown in FIG. 6C. From this sum provided by the adder chips 178 is substracted the output from the adder chips 176 as achieved by inverters 180 and adder chips 182 shown in FIG. 6B. This difference is compared by integrated circuit comparator chips 184 to determine if the difference is less than one inch. If it is, no correction is made. The difference is also provided to integrated circuit adder chips 186 for addition with 7F (octal) to establish an offset binary code which is then provided to a multiplexer means 188. The output of the multiplexer means 188 is provided as a "FILL ERROR" as indicated in FIG. 6B and as an input to a digital-to-analog converter means 190 shown in FIG. 6D for converting the digital signal into an analog signal to control a servomechanism controlling the valve means 78 and 80 shown in FIG. 1.

It is contemplated that the return volume control means can be digitally implemented with PROMs and the like. Such digital implementation will facilitate the incorporation of a phase error correction factor into the return volume calculations, thereby enhancing the accuracy of control achieved by the return volume control means.

FIGS. 7A–7B disclose a schematic circuit diagram of the preferred embodiment of the quadruplex-to-triplex conversion control means of the control means 14. The quadruplex-to-triplex conversion means includes conversion switch means for initiating the conversion of the operation of the apparatus 2 from quadruplex operation wherein all four of the pumping sections are utilized to triplex operation wherein only three of the four pumping sections are utilized. The conversion switch means as shown in FIG. 7A has a manual switch 192 which actuates a latch means 194 and thereby enables additional manual switch means 196, 198, 200, and 202. The switch means 196–202 constitute pumping section select switch means for selecting which one of the four pumping sections is to be disabled during triplex operation.

Once the conversion switch means 192 has been manually actuated and one of the pumping section select switch means 196–202 has been actuated, the remainder of the circuitry shown in FIGS. 7A and 7B operates to delete the selected pumping section from operation and to control the various other elements of the apparatus 2 in accordance with the selected triplex operation. The timing of the conversion is controlled by the address of the leading discharge pumping section as received by a demultiplexer and debounce circuit 204. Under control of this timing, a triplex conversion solenoid actuation signal is provided as labeled in FIG. 7A to the solenoid of the valve for disabling the phase control means of the control means 14, such as by shunting the fluid flow around the variable orifice means 70 shown in FIG. 1. As also shown in FIG. 7A, the control signals $C_1$–$C_4$ are generated by the quadruplex-to-triplex conversion means. By shunting the fluid flow around the variable orifice means 70, the flow from the pump 8 goes directly to the paired inlet valves 48*a*, 48*c* and the paired inlet valves 48*b*, 48*d* without adjustment since there is no trailing discharge plunger means in triplex operation; however, this shunting is not what causes the conversion from quadruplex to triplex. The conversion occurs through the control of the inlet valves as indicated by the $C_1$–$C_4$ signals and the CF signal shown in FIGS. 7A and 7B.

It is to be noted that the conversion from quadruplex operation to triplex operation occurs "on the fly;" that is, while each of the pumping sections is operating. It is to be further noted that the preferred embodiment apparatus 2 does not enter the second mode when operating in triplex; however, the output of the apparatus 2 is otherwise unaffected by a conversion from quadruplex to triplex.

The circuit shown in FIG. 7B provides the "CF" signal for closing the desired inlet valve when the apparatus 2 enters triplex operation. This is achieved by having the "CF" signal as a part of the control 82 for opening the fill valve 78 shown in FIG. 1.

The preferred embodiment of the mode control means of the control means 14 is schematically illustrated in FIG. 8. The mode selection control means senses the power end pressure (via a pressure limit switch, not shown) and stroke (via a stroke limit switch, not shown) of the pump means 4 and selects the number of cylinders in each of the pumping sections which are to receive fluid from the pump means 4 dependent upon the sensed pressure and stroke. In response to the signals from the pressure limit switch and stroke limit switch of the pump means 4, the circuit shown in FIG. 8 provides, via an integrated circuit shift register means 206, mode control signals $M_1$, $M_2$, $M_3$, and $M_4$ and selector valve control signals $SV_1$ and $SV_2$. Not all of these signals need to be used in the preferred embodiment which operates in only either of two modes; however, these signals are all shown as illustrating that the present invention can encompass more modes than just two.

Also shown in FIG. 8 is a pump destroke (PD) signal which destrokes the pump 8 prior to a shift from mode 1 to mode 2. In the preferred embodiment destroking occurs until the sixty-five percent full stroke point is reached.

The mode in which the apparatus 2 operates is dependent upon the sensed pressure and stroke or flow rate of the pump means 4. For example, for a lower flow rate and a greater pressure, a first mode is entered whereby the inlets 56*a*, 56*b*, 56*c*, and 56*d* of the first, second, third and fourth mode selector valves are opened thereby allowing fluid from the pump means 4 to act against each of the pistons in each of the pumping sections. For a greater flow rate and lower pressure, the apparatus 2 operates in a second mode whereby the inlets of the first, second, third and fourth mode selector valves are closed to prevent two of the four cylinders in each of the pumping sections from receiving the driving fluid from the pump means 4. This is analogous to the shifting of gears in an automobile. A graphic illustration of the mode ranges is shown in FIG. 10.

From FIGS. 8 and 10 and the foregoing description it is apparent that the mode control means of the preferred embodiment further includes first mode control means and second mode control means. The first mode control means provides the $M_1$ signal (shown in FIG. 8) to open the inlets 56*a*, 56*b*, 56*c* and 56*d* of the first, second, third and fourth mode selector valves in response to the pressure sensing means comprising, for example, the aforementioned pressure limit switch that provides the signal designated "PRESSURE" in FIG. 8. In the illustrated preferred embodiment the pressure sensing means senses when the "MODE 2 MAXIMUM PRESSURE" (FIG. 10) is reached and thereby causes the first mode control means to provide the $M_1$ signal so that the illustrated embodiment of the present invention will operate in the first mode. The preferred embodiment of the first mode control means is shown in FIG. 8 to include those elements responsive to the "PRESSURE" signal.

The second mode control means provides the $M_2$ signal (shown in FIG. 8) to close the inlets 56*a*, 56*b*, 56*c* and 56*d* of the first, second, third and fourth mode selector valves in response to the stroke sensing means comprising, for example, the aforementioned stroke limit switch which provides the "FULL STROKE" and "65% FULL STROKE" signals designated in FIG. 8. In the illustrated preferred embodiment the stroke limit switch senses when the "MODE 1 MAXIMUM STROKE" (FIG. 10) is reached. When this occurs, the "FULL STROKE" signal enables the aforementioned pump destroke (PD) signal to be generated so that the pump 8 is destroked. When the pump has been destroked to sixty-five percent of full stroke, the "65% FULL STROKE" signal enables the shift register means 206 to generate the $M_2$ signal. The preferred embodiment of the second mode control means is shown in FIG. 8 to include those elements responsive to the "FULL STROKE" and "65% FULL STROKE" signals.

It is to be noted that the disclosed preferred embodiment includes the specific elements identified in the drawings; however, the specific values and integrated circuit components are not to be taken as limiting of the scope of the invention. It is contemplated, for example, that much of the control means 14 can be implemented by a microcomputer.

The overall operation of the apparatus 2 is evident from the foregoing disclosure and thus will not be specifically reiterated. Generally, however, it is apparent that the apparatus 2 is a multiple-mode device in that it can operate in either a first mode or a second mode as just described for the preferred embodiment shown in the accompanying drawings. Additionally, the apparatus 2 is a multiplex device in that it can operate either as a quadruplex pumping apparatus or a triplex pumping apparatus. It is also apparent that the present invention maintains a continuous fluid flow in both quadruplex and triplex by means of the phase control means, stop point control means, return volume control means and valve control means described hereinabove. Each of these means is likewise properly maintained by means of the initialization means which properly positions each of the pistons and plungers in each of the pumping sections upon energization of the apparatus 2.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

APPENDIX 1

LEADING AND TRAILING PUMPING SECTION ADDRESSES (PROM 87)

| | | |
|---|---|---|
| Leading Address (Quadruplex): | $A_{LQ}$ (MSB) | $B_{LQ}$ (LSB) |
| Trailing Address (Quadruplex): | $A_{TQ}$ (MSB) | $B_{TQ}$ (LSB) |
| Discharge Address (Triplex): | $A_{DT}$ (MSB) | $B_{DT}$ (LSB) |

$A_L = A_{LQ} + A_{DT}$
$B_L = B_{LQ} + B_{DT}$
$A_T = A_{TQ} + A_{DT}$
$B_T = B_{TQ} + B_{DT}$
$Q = 1$ for quadruplex operation
$= 0$ for triplex operation
$C_i = 1$ if section # i is dropped
$= 0$ otherwise
$i = 1, 2, 3$ or $4$ $$A_{LQ} = Q \cdot [\bar{I}_1\bar{I}_2I_3I_4 + I_1\bar{I}_2I_3I_4 + I_1\bar{I}_2\bar{I}_3I_4 + I_1I_2\bar{I}_3I_4]$$
$$B_{LQ} = Q \cdot [\bar{I}_1I_2I_3\bar{I}_4 + \bar{I}_1I_2I_3I_4 + I_1\bar{I}_2\bar{I}_3I_4 + I_1I_2\bar{I}_3I_4]$$
$$A_{TQ} = Q \cdot [\bar{I}_1I_2I_3\bar{I}_4 + \bar{I}_1I_2I_3I_4 + \bar{I}_1\bar{I}_2I_3I_4 + I_1\bar{I}_2I_3I_4]$$
$$B_{TQ} = Q \cdot [I_1I_2\bar{I}_3\bar{I}_4 + I_1\bar{I}_2I_3\bar{I}_4 + \bar{I}_1\bar{I}_2I_3I_4 + I_1\bar{I}_2\bar{I}_3I_4]$$
$$A_{DT} = C_1 \cdot [\bar{I}_1\bar{I}_2I_3\bar{I}_4 + \bar{I}_1\bar{I}_2I_3I_4 + \bar{I}_1\bar{I}_2\bar{I}_3I_4 + \bar{I}_1\bar{I}_2\bar{I}_3I_4] + C_2 \cdot [\bar{I}_1I_2I_3\bar{I}_4 + \bar{I}_1\bar{I}_2I_3\bar{I}_4 + \bar{I}_1\bar{I}_2\bar{I}_3I_4 + \bar{I}_1\bar{I}_2\bar{I}_3I_4 + I_1\bar{I}_2\bar{I}_3I_4] + C_3 \cdot [\bar{I}_1\bar{I}_2I_3I_4 + \bar{I}_1\bar{I}_2\bar{I}_3I_4 + I_1\bar{I}_2\bar{I}_3I_4] + C_4 \cdot [\bar{I}_1\bar{I}_2I_3\bar{I}_4 + I_1\bar{I}_2\bar{I}_3\bar{I}_4]$$
$$B_{DT} = 0$$

APPENDIX 2

Next Trailing or Discharge Cylinder Address (PROM 110):

$$X = Q\bar{A}_L + C_1A_L\bar{B}_L + C_2\bar{B}_L + \bar{A}_LB_L(C_1 + C_3 + C_4)$$
$$Y = QB_L + A_L(C_1 + C_2\bar{B}_L) + \bar{A}_L(C_3 + C_4\bar{B}_L)$$

Reset signals for flip-flops (PROM 112):

APPENDIX 2-continued

Next Trailing or Discharge Cylinder Address (PROM 110):

$$\bar{R}_1 = C_1 + (C_3TI_2 + C_4TI_2 + C_2TI_3 + Q\,TI_3)$$
$$\bar{R}_2 = C_2 + (C_1TI_3 + C_4TI_3 + C_3TI_4 + Q\,TI_4)$$
$$\bar{R}_3 = C_3 + (C_1TI_4 + C_2TI_4 + C_4TI_1 + Q\,TI_1)$$
$$\bar{R}_4 = C_4 + (C_2TI_1 + C_3TI_1 + C_1TI_2 + Q\,TI_2)$$

where, $TI_1$ = Trigger signal to set Z1 flip-flop
$TI_2$ = Trigger signal to set Z2 flip-flop
$TI_3$ = Trigger signal to set Z3 flip-flop
$TI_4$ = Trigger signal to set Z4 flip-flop

APPENDIX 3

EXHAUST VALVE PROM (PROM 114)

$$T'_1 = Q \cdot (\bar{I}_1I_2I_3\bar{I}_4 + \bar{I}_1I_2I_3I_4) + C_2 \cdot (\bar{I}_1I_2I_3\bar{I}_4 + \bar{I}_1\bar{I}_2I_3\bar{I}_4 + \bar{I}_1\bar{I}_2I_3I_4) + C_3 \cdot (\bar{I}_1I_2\bar{I}_3\bar{I}_4 + \bar{I}_1I_2\bar{I}_3I_4) + C_4 \cdot (\bar{I}_1I_2\bar{I}_3\bar{I}_4 + \bar{I}_1I_2I_3\bar{I}_4)$$
$$T'_2 = Q \cdot (\bar{I}_1\bar{I}_2I_3I_4 + I_1\bar{I}_2I_3I_4) C_1 \cdot (\bar{I}_1\bar{I}_2I_3\bar{I}_4 + \bar{I}_1\bar{I}_2\bar{I}_3I_4) + C_3 \cdot (\bar{I}_1\bar{I}_2I_3I_4 + \bar{I}_1\bar{I}_2\bar{I}_3I_4 + I_1\bar{I}_2\bar{I}_3I_4) + C_4 \cdot (\bar{I}_1\bar{I}_2I_3\bar{I}_4 + I_1\bar{I}_2I_3I_4)$$
$$T'_3 = Q \cdot (I_1\bar{I}_2\bar{I}_3I_4 + I_1I_2\bar{I}_3I_4) + C_1 \cdot (\bar{I}_1\bar{I}_2\bar{I}_3I_4 + \bar{I}_1\bar{I}_2\bar{I}_3I_4) + C_2 \cdot (\bar{I}_1\bar{I}_2\bar{I}_3I_4 + I_1\bar{I}_2\bar{I}_3I_4) + C_4 \cdot (I_1\bar{I}_2\bar{I}_3I_4 + I_1\bar{I}_2\bar{I}_3I_4 + I_1I_2\bar{I}_3\bar{I}_4)$$
$$T'_4 = Q \cdot (I_1I_2\bar{I}_3\bar{I}_4 + I_1\bar{I}_2I_3\bar{I}_4) + C_1 \cdot (I_1\bar{I}_2\bar{I}_3\bar{I}_4 + \bar{I}_1\bar{I}_2\bar{I}_3\bar{I}_4) + C_2 \cdot (I_1\bar{I}_2\bar{I}_3\bar{I}_4 + I_1\bar{I}_2I_3\bar{I}_4) + C_3 \cdot (I_1\bar{I}_2\bar{I}_3\bar{I}_4 + I_1I_2\bar{I}_3\bar{I}_4)$$

APPENDIX 4

INLET VALVE OVERLAP (IOLAP-PROM 118)

$$IOLAP = IOLAP_{QUAD} + IOLAP_{TRIPLEX}$$
$$IOLAP_{QUAD} = Q \cdot [I_1\bar{I}_2I_3\bar{I}_4 + I_1I_2I_3\bar{I}_4 + \bar{I}_1I_2\bar{I}_3I_4 + I_1I_2\bar{I}_3I_4 + I_1\bar{I}_2I_3I_4 + \bar{I}_1I_2I_3I_4]$$
$$IOLAP_{TRIPLEX} = I_AI_B + I_BI_C + I_CI_A = C_1 \cdot [\bar{I}_1I_2I_3\bar{I}_4 + \bar{I}_1\bar{I}_2I_3I_4 + \bar{I}_1I_2\bar{I}_3I_4 + I_1I_2\bar{I}_3I_4] + C_2 \cdot [I_1\bar{I}_2I_3\bar{I}_4 + I_1I_2I_3\bar{I}_4 + \bar{I}_1\bar{I}_2I_3I_4 + I_1\bar{I}_2\bar{I}_3I_4] + C_3 \cdot [I_1I_2\bar{I}_3\bar{I}_4 + \bar{I}_1I_2\bar{I}_3I_4 + \bar{I}_1I_2I_3I_4 + I_1\bar{I}_2\bar{I}_3I_4] + C_4 \cdot [I_1I_2I_3\bar{I}_4 + \bar{I}_1I_2I_3\bar{I}_4 + I_1\bar{I}_2I_3\bar{I}_4 + I_1\bar{I}_2I_3I_4]$$

APPENDIX 5

PRECOMPRESSION PROM (PROM 120)

$$P_1 = Q \cdot (\bar{E}_1E_2\bar{E}_3\bar{E}_4 + \bar{E}_1E_2E_3\bar{E}_4) + C_2 \cdot (\bar{E}_1\bar{E}_2E_3\bar{E}_4 + \bar{E}_1\bar{E}_2E_3E_4) + C_3 \cdot (\bar{E}_1E_2\bar{E}_3\bar{E}_4 + \bar{E}_1E_2\bar{E}_3E_4) + C_4 \cdot (\bar{E}_1E_2\bar{E}_3\bar{E}_4 + \bar{E}_1E_2E_3\bar{E}_4)$$
$$P_2 = Q \cdot (\bar{E}_1\bar{E}_2E_3\bar{E}_4 + \bar{E}_1\bar{E}_2E_3E_4) + C_1 \cdot (\bar{E}_1\bar{E}_2E_3\bar{E}_4 + \bar{E}_1\bar{E}_2E_3E_4) + C_3 \cdot (\bar{E}_1\bar{E}_2\bar{E}_3E_4 + E_1\bar{E}_2\bar{E}_3E_4) + C_4 \cdot (\bar{E}_1\bar{E}_2E_3\bar{E}_4 + E_1\bar{E}_2E_3\bar{E}_4)$$
$$P_3 = Q \cdot (\bar{E}_1\bar{E}_2\bar{E}_3E_4 + E_1\bar{E}_2\bar{E}_3E_4) + C_1 \cdot (\bar{E}_1\bar{E}_2\bar{E}_3E_4 + \bar{E}_1\bar{E}_2\bar{E}_3E_4) + C_2 \cdot (\bar{E}_1\bar{E}_2\bar{E}_3E_4 + E_1\bar{E}_2\bar{E}_3E_4) + C_4 \cdot (E_1\bar{E}_2\bar{E}_3\bar{E}_4 + E_1\bar{E}_2\bar{E}_3\bar{E}_4)$$

What is claimed is:

1. A pumping apparatus, comprising:

a first pumping section including first plunger means;

a second pumping section including second plunger means;

a third pumping section including third plunger means;

a fourth pumping section including fourth plunger means; and control means for operating said four plunger means in a pumping cycle wherein each of said four plunger means functions at different times as a precompression plunger means, a trailing discharge plunger means, a leading discharge plunger means, and a suction plunger means, said control means including phase control means for controlling the spacing between any of said first, second, third and fourth plunger means functioning as the leading discharge plunger means and any of said first, second, third and fourth plunger means functioning as the trailing discharge plunger means, said phase control means including:

means for subtracting a detected position of the plunger means functioning as the precompression plunger means from a predetermined stroke-length and for dividing the difference by two, thereby defining a phase difference to be maintained between the plunger means functioning as the leading discharge plunger means and the plunger means functioning as the trailing discharge plunger means;

means for adding said phase difference to a detected position of the plunger means functioning as the trailing discharge plunger means, thereby defining a sum;

means for subtracting said sum from a detected position of the plunger means functioning as the leading discharge plunger means, thereby defining a phase error; and means, responsive to said phase error, for correcting the position of the plunger means functioning as the trailing discharge plunger means.

2. A pumping apparatus, comprising:

a first pumping section including first plunger means and first inlet valve means associated with said first plunger means;

a second pumping section including second plunger means and second inlet valve means associated with said second plunger means;

a third pumping section including third plunger means and third inlet valve means associated with said third plunger means;

a fourth pumping section including fourth plunger means and fourth inlet valve means associated with said fourth plunger means; and stop point control means for controlling the positions at which each of said first, second, third and fourth plunger means stops at the end of its movement as a leading discharge plunger means, said stop point control means including:

means for determining a wait time of one of said inlet valve means, said one of said inlet valve means including:

a solenoid having a solenoid response time; and a valve member movable between an open position and a closed position in response to actuation of said solenoid; and said means for determining the wait time of one of said inlet valve means including:

means for determining a duration from the time of an actuation of said solenoid to the time at which said valve member is moved to said closed position in response to said actuation of said solenoid;

means for dividing said duration by two, thereby defining a quotient; and means for adding a predetermined solenoid response time to said quotient, thereby defining said wait time;

means for calculating the distance which the corresponding plunger means associated with said one of said inlet valve means moves during said wait time;

means for subtracting said distance from a predetermined stroke length, thereby defining a trigger point position; and means for actuating said one of said inlet valve means when said corresponding plunger means moves to said trigger point position.

3. A pumping apparatus, comprising:

a first pumping section including:

first power end piston means including a first plurality of cylinders;

first inlet valve means associated with said first power end piston means, said first inlet valve means including a first inlet valve, a first conduit means for connecting said first inlet valve to a first set of said first plurality of cylinders, and a second conduit means for connecting said first inlet valve to a second set of said first plurality of cylinders; and first mode valve means including a first mode inlet disposed in said second conduit means between said first inlet valve and said second set of said first plurality of cylinders;

a second pumping section including:

second power end piston means including a second plurality of cylinders;

second inlet valve means associated with said second power end piston means, said second inlet valve means including a second inlet valve, a third conduit means for connecting said second inlet valve to a first set of said second plurality of cylinders, and a fourth conduit means for connecting said second inlet valve to a second set of said second plurality of cylinders; and second mode valve means including a second mode inlet disposed in said fourth conduit means between said second inlet valve and said second set of said second plurality of cylinders;

a third pumping section including:

third power end piston means including a third plurality of cylinders;

third inlet valve means associated with said third power end piston means, said third inlet valve means including a third inlet valve, a fifth conduit means for connecting said third inlet valve to a first set of said third plurality of cylinders, and a sixth conduit means for connecting said third inlet valve to a second set of said third plurality of cylinders; and third mode valve means including a third mode inlet disposed in said sixth conduit means between said third inlet valve and said second set of said third plurality of cylinders;

a fourth pumping section including:

fourth power end piston means including a fourth plurality of cylinders;

fourth inlet valve means associated with said fourth power end piston means, said fourth inlet valve means including a fourth inlet valve, a seventh conduit means for connecting said fourth inlet valve to a first set of said fourth plurality of cylinders, and an eighth conduit means for connecting said fourth inlet valve to a second set of said fourth plurality of cylinders; and fourth mode valve means including a fourth mode inlet disposed in said eighth conduit means between said fourth inlet valve and said second set of said fourth plurality of cylinders;

pressure sensing means for sensing pressure in a power end of a drive pump to which said apparatus is connectible;

stroke sensing means for sensing the stroke of the drive pump to which said apparatus is connectible;

first mode control means; responsive to said pressure sensing means, for opening said first, second, third, and fourth mode inlets; and second mode control means, responsive to said stroke sensing means, for closing said first, second, third, and fourth mode inlets.

4. A pumping apparatus, comprising:

a first pumping section including first power end piston means having a first rod end volume portion;

a second pumping section including second power end piston means having a second rod end volume portion;

a third pumping section including third power end piston means having a third rod end volume portion;

a fourth pumping section including fourth power end piston means having a fourth rod end volume portion;

means for computing a required quantity proportional to the volume of fluid required in the respective rod end volume portions of said first, second, third, and fourth power end piston means, said means for computing a required quantity including:

means for determining an average precompression length;

means for adding the average precompression length to a predetermined stroke length;

means for multiplying the sum of the average precompression length and the predetermined stroke length by 1.5, thereby providing a product;

means for adding a predetermined minimum precompression length to said product;

means for determining the change in the position of the one of said first, second, third, or fourth power end piston means functioning as a trailing discharge piston means over a predetermined period of time; and means for adding the change in position to the sum of the predetermined minimum precompression length and said product, thereby establishing a sum of required volume;

means for calculating an actual quantity proportional to the actual volume of fluid contained in the respective rod end volume portions of said first, second, third, and fourth power end piston means, said means for calculating an actual quantity including means for adding all of the detected positions of said first, second, third, and fourth power end piston means, thereby establishing a sum of actual volume;

means for generating a difference signal representing the difference between said actual quantity and said required quantity, said means for generating a difference signal including means for subtracting said sum of required volume from said sum of actual volume; and means, responsive to said difference signal, for adding fluid to the respective rod end volume portions of said first, second, third and fourth power end piston means.

5. A pumping apparatus, including:

a first pumping section including:

first power end piston means;

first fluid end plunger means;

first coupling means for coupling said first power end piston means with said first fluid end piston means;

first inlet valve means associated with said first power end piston means;

first exhaust valve means associated with said first power end piston means; and first precompression circuit means associated with said first power end piston means;

a second pumping section including:

second power end piston means;

second fluid end plunger means;

second coupling means for coupling said second power end piston means with said second fluid end piston means;

second inlet valve means associated with said second power end piston means;

second exhaust valve means associated with said second power end piston means; and second precompression circuit means associated with said second power end piston means;

a third pumping section including:

third power end piston means;

third fluid end plunger means;

third coupling means for coupling said third power end piston means with said third fluid end piston means;

third inlet valve means associated with said third power end piston means;

third exhaust valve means associated with said third power end piston means; and third precompression circuit means associated with said third power end piston means;

a fourth pumping section including:

fourth power end piston means;

fourth fluid end plunger means;

fourth coupling means for coupling said fourth power end piston means with said fourth fluid end piston means;

fourth inlet valve means associated with said fourth power end piston means;

fourth exhaust valve means associated with said fourth power end piston means; and fourth precompression circuit means associated with said fourth power end piston means; and control means for controlling the operation of said four pumping sections, said control means including:

encoder means for providing respective signals representing the actual positions of said first, second, third and fourth fluid end plunger means and said first, second, third and fourth power end piston means;

initialization means for placing said first fluid end plunger means at a first position as an initial leading discharge plunger means, for placing said second fluid end plunger means at a second position as an initial trailing discharge plunger means, for placing said third fluid end plunger means at a third position as an initial precompression plunger means, and for placing said fourth fluid end plunger means at a fourth position as an initial suction plunger means, said initialization means including:

first comparator means for comparing the signal representing the actual position of said first fluid end plunger means with a signal representing a predetermined starting position of said first fluid end plunger means;

second comparator means for comparing the signal representing the actual position of said second fluid end plunger means with a signal representing a predetermined starting position of said second fluid end plunger means;

third comparator means for comparing the signal representing the actual position of said third fluid end plunger means with a signal representing a predetermined starting position of said third fluid end plunger means;

fourth comparator means for comparing the signal representing the actual position of said fourth fluid end plunger means with a signal representing a predetermined starting position of said fourth fluid end plunger means;

means for opening said first exhaust valve means when said first comparator means indicates the actual position of said first fluid end plunger means is greater than the predetermined starting position thereof;

means for opening said second exhaust valve means when said second comparator means indicates the actual position of said second fluid end plunger means is greater than the predetermined starting position thereof;

means for opening said third exhaust valve means when said third comparator means indicates the actual position of said third fluid end plunger means is greater than the predetermined starting position thereof;

means for opening said first inlet valve means when said first comparator means indicates the actual position of said first fluid end plunger means is less than the predetermined starting position thereof; and means for opening said fourth inlet valve means when said fourth comparator means indicates the actual position of said fourth fluid end plunger means is less than the predetermined starting position thereof;

inlet valve control means for controlling the positions of said first, second, third and fourth inlet valve means;

inlet valve detector means for detecting the positions of said first, second, third and fourth inlet valve means;

exhaust valve control means, responsive to said inlet valve detector means, for controlling the positions of said first, second, third and fourth exhaust valve means;

exhaust valve detector means for detecting the positions of said first, second, third and fourth exhaust valve means;

precompression circuit control means, responsive to said exhaust valve detector means, for controlling said first, second, third and fourth precompression circuit means;

phase control means for controlling the spacing between any of said first, second, third and fourth plunger means functioning as the leading discharge plunger means and any of said first, second, third and fourth plunger means functioning as the trailing discharge plunger means; and stop point control means for controlling the positions at which each of said first, second, third and fourth plunger means stops at the end of its movement as the leading discharge plunger means.

6. An apparatus as defined in claim 5, wherein said phase control means includes:

means for subtracting the detected position of the fluid end plunger means functioning as the precompression plunger means from a predetermined stroke length and for dividing the difference by two, thereby defining a phase difference to be maintained between the fluid end plunger means functioning as the leading discharge plunger means and the fluid end plunger means functioning as the trailing discharge plunger means;

means for adding said phase difference to the detected position of the trailing discharge plunger means, thereby defining a sum;

means for subtracting said sum from the detected position of the leading discharge plunger means, thereby defining a phase error; and means, responsive to said phase error, for correcting the position of the trailing discharge plunger means.

7. An apparatus as defined in claim 6, wherein said stop point control means includes:

means for determining a wait time of one of said inlet valve means;

means for calculating the distance which the corresponding fluid end plunger means associated with said one of said inlet valve means moves during said wait time;

means for subtracting said distance from the predetermined stroke length, thereby defining a trigger point position; and means for actuating said one of said inlet valve means when said corresponding fluid end plunger means moves to said trigger point position.

8. An apparatus as defined in claim 7, wherein:

said one of said inlet valve means includes:

a solenoid having a solenoid response time; and a valve member movable between an open position and a closed position in response to actuation of said solenoid; and said means for determining the wait time of one of said inlet valve means includes:

means for determining a duration from the time of an actuation of said solenoid to the time at which said valve member is moved to said closed position in response to said actuation of said solenoid;

means for dividing said duration by two, thereby defining a quotient; and means for adding a predetermined solenoid response time to said quotient, thereby defining said wait time.

9. An apparatus as defined in claim 8, wherein:

said first power end piston means includes a first plurality of cylinders;

said second power end piston means includes a second plurality of cylinders;

said third power end piston means includes a third plurality of cylinders;

said fourth power end piston means includes a fourth plurality of cylinders;

said first inlet valve means includes a first inlet valve, a first conduit means for connecting said first inlet valve to a first set of said first plurality of cylinders, and a second conduit means for connecting said first inlet valve to a second set of said first plurality of cylinders;

said second inlet valve means includes a second inlet valve, a third conduit means for connecting said second inlet valve to a first set of said second plurality of cylinders, and a fourth conduit means for connecting said second inlet valve to a second set of said second plurality of cylinders;

said third inlet valve means includes a third inlet valve, a fifth conduit means for connecting said third inlet valve to a first set of said third plurality of cylinders, and a sixth conduit means for connecting said third inlet valve to a second set of said third plurality of cylinders;

said fourth inlet valve means includes a fourth inlet valve, a seventh conduit means for connecting said fourth inlet valve to a first set of said fourth plurality of cylinders, and an eighth conduit means for connecting said fourth inlet valve to a second set of said fourth plurality of cylinders;

said first pumping section further includes first mode valve means including a first mode inlet disposed in said second conduit means between said first inlet valve and said second set of said first plurality of cylinders;

said second pumping section further includes second mode valve means including a second mode inlet disposed in said fourth conduit means between said second inlet valve and said second set of said second plurality of cylinders;

said third pumping section further includes third mode valve means including a third mode inlet disposed in said sixth conduit means between said third inlet valve and said second set of said third plurality of cylinders;

said fourth pumping section further includes fourth mode valve means including a fourth mode inlet disposed in said eighth conduit means between said fourth inlet valve and said second set of said fourth plurality of cylinders; and said control means further includes:

pressure sensing means for sensing pressure in a power end of a drive pump to which said apparatus is connectible;

stroke sensing means for sensing the stroke of the drive pump to which said apparatus is connectible;

first mode control means, responsive to said pressure sensing means, for opening said first, second, third and fourth mode inlets; and second mode control means, responsive to said stroke sensing means, for closing said first, second, third and fourth mode inlets.

10. An apparatus as defined in claim 9, wherein said control means further includes:

conversion switch means for initiating the conversion of the operation of said apparatus from quadruplex operation wherein all four of said four pumping sections are utilized to triplex operation wherein only three of said four pumping sections are utilized;

pumping section select switch means for selecting which one of said four pumping sections is to be disabled during triplex operation; and timing means, responsive to said conversion switch means and said pumping section select switch means, for controlling the time at which said apparatus switches to triplex operation.

11. An apparatus as defined in claim 10, wherein said control means further includes:

means for computing a required quantity proportional to the volume of fluid required in respective end portions of said first, second, third and fourth power end piston means;

means for calculating an actual quantity proportional to the actual volume of fluid contained in the respective end portions of said first, second, third and fourth power end piston means;

means for generating a difference signal representing the difference between said actual quantity and said required quantity; and means, responsive to said difference signal, for adding fluid to the respective end portions of said first, second, third and fourth power end piston means.

12. An apparatus as defined in claim 11, wherein:

said means for computing a required quantity includes:

means for determining an average precompression length;

means for adding the average precompression length to the predetermined stroke length;

means for multiplying the sum of the average precompression length and the predetermined stroke-length by 1.5, thereby providing a product;

means for adding a predetermined minimum precompression length to said product;

means for determining the change in the position of the one of said first, second, third or fourth fluid end plunger means functioning as the trailing discharge plunger means over a predetermined period of time; and means for adding the change in position to the sum of the predetermined minimum precompression length and said product, thereby establishing a sum of required volume;

said means for calculating an actual quantity includes means for adding all the detected positions of said first, second, third and fourth power end piston means, thereby establishing a sum of actual volume; and said means for generating a difference signal includes means for subtracting said sum of required volume from said sum of actual volume.

13. A pumping apparatus, comprising:

a first pumping section including:

first power end piston means;

first fluid end plunger means;

first coupling means for coupling said first power end piston means with said first fluid end piston means;

first inlet valve means associated with said first power end piston means;

first exhaust valve means associated with said first power end piston means; and first precompression circuit means associated with said first power end piston means;

a second pumping section including:

second power end piston means;

second fluid end plunger means;

second coupling means for coupling said second power end piston means with said second fluid end piston means;

second inlet valve means associated with said second power end piston means;

second exhaust valve means associated with said second power end piston means; and second precompression circuit means associated with said second power end piston means;

a third pumping section including:

third power end piston means;

third fluid end plunger means;

third coupling means for coupling said third power end piston means with said third fluid end piston means;

third inlet valve means associated with said third power end piston means;

third exhaust valve means associated with said third power end piston means; and third precompression circuit means associated with said third power end piston means;

a fourth pumping section including:

fourth power end piston means;

fourth fluid end plunger means;

fourth coupling means for coupling said fourth power end piston means with said fourth fluid end piston means;

fourth inlet valve means associated with said fourth power end piston means;

fourth exhaust valve means associated with said fourth power end piston means; and fourth precompression circuit means associated with said fourth power end piston means;

control means for controlling the operation of said four pumping sections, said control means including:

initialization means for placing said first fluid end plunger means at a first position as an initial leading discharge plunger means, for placing said second fluid end plunger means at a second position as an initial trailing discharge plunger means, for placing said third fluid end plunger means at a third position as an initial precompression plunger means, and for placing said fourth fluid end plunger means at a fourth position as an initial suction plunger means;

inlet valve control means for controlling the positions of said first, second, third and fourth inlet valve means;

inlet valve detector means for detecting the positions of said first, second, and third and fourth inlet valve means;

exhaust valve control means, responsive to said inlet valve detector means, for controlling the positions of said first, second, third and fourth exhaust valve means;

exhaust valve detector means for detecting the positions of said first, second, third and fourth exhaust valve means;

precompression circuit control means, responsive to said exhaust valve detector means, for controlling said first second, third and fourth precompression circuit means;

phase control means for controlling the spacing between any of said first, second, third and fourth plunger means functioning as the leading discharge plunger means and any of said first, second, third and fourth plunger means functioning as the trailing discharge plunger means;

stop point control means for controlling the positions at which each of said first, second, third and fourth plunger means stops at the end of its movement as the leading discharge plunger means; and mode control means for shifting said first, second, third and fourth power end piston means between a first mode of operation and a second mode of operation in response to the pressure and stroke of a drive pump to which said apparatus is connectible; and wherein:

said first power end piston means includes a first plurality of cylinders;

said second power end piston means includes a second plurality of cylinders;

said third power end piston means includes a third plurality of cylinders;

said fourth power end piston means includes a fourth plurality of cylinders;

said first inlet valve means includes a first inlet valve, a first conduit means for connecting said first inlet valve to a first set of said first plurality of cylinders, and a second conduit means for connecting said first inlet valve to a second set of said first plurality of cylinders;

said second inlet valve means includes a second inlet valve, a third conduit means for connecting said second inlet valve to a first set of said second plurality of cylinders, and a fourth conduit means for connecting said second inlet valve to a second set of said second plurality of cylinders;

said third inlet valve means includes a third inlet valve, a fifth conduit means for connecting said third inlet valve to a first set of said third plurality of cylinders, and a sixth conduit means for connecting said third inlet valve to a second set of said third plurality of cylinders;

said fourth inlet valve means includes a fourth inlet valve, a seventh conduit means for connecting said fourth inlet valve to a first set of said fourth plurality of cylinders, and an eighth conduit means for connecting said fourth inlet valve to a second set of said fourth plurality of cylinders;

said first pumping section further includes first mode valve means including a first mode inlet disposed in said second conduit means between said first inlet valve and said second set of said first plurality of cylinders;

said second pumping section further includes second mode valve means including a second mode inlet disposed in said fourth conduit means between said second inlet valve and said second set of said second plurality of cylinders;

said third pumping section further includes a third mode valve means including a third mode inlet disposed in said sixth conduit means between said third inlet valve and said second set of said third plurality of cylinders;

said fourth pumping section further includes fourth mode valve means including a fourth mode inlet disposed in said eighth conduit means between said fourth inlet valve and said second set of said fourth plurality of cylinders; and said mode control means includes:

pressure sensing means for sensing pressure in a power end of a drive pump to which said apparatus is connectible;

stroke sensing means for sensing the stroke of the drive pump to which said apparatus is connectible;

first mode control means, responsive to said pressure sensing means, for opening said first, second, third and fourth mode inlets; and second mode control means, responsive to said stroke sensing means, for closing said first, second, third and fourth mode inlets.

14. A pumping apparatus, comprising:

a first pumping section including:

first power end piston means;

first fluid end plunger means;

first coupling means for coupling said first power end piston means with said first fluid end piston means;

first inlet valve means associated with said first power end piston means;

first exhaust valve means associated with said first power end piston means; and first precompression circuit means associated with said first power end piston means;

a second pumping section including:
second power end piston means;
second fluid end plunger means;
second coupling means for coupling said second power end piston means with said second fluid end piston means;
second inlet valve means associated with said second power end piston means;
second exhaust valve means associated with said second power end piston means; and
second precompression circuit means associated with said second power end piston means;
a third pumping section including:
third power end piston means;
third fluid end plunger means;
third coupling means for coupling said third power end piston means with said third fluid end piston means;
third inlet valve means associated with said third power end piston means;
third exhaust valve means associated with said third power end piston means; and
third precompression circuit means associated with said third power end piston means;
a fourth pumping section including:
fourth power end piston means;
fourth fluid end plunger means;
fourth coupling means for coupling said fourth power end piston means with said fourth fluid end piston means;
fourth inlet valve means associated with said fourth power end piston means;
fourth exhaust valve means associated with said fourth power end piston means; and
fourth precompression circuit means associated with said fourth power end piston means; and
control means for controlling the operation of said four pumping sections, said control means including:
initialization means for placing said first fluid end plunger means at a first position as an initial leading discharge plunger means, for placing said second fluid end plunger means at a second position as an initial trailing discharge plunger means, for placing said third fluid end plunger means at a third position as an initial precompression plunger means, and for placing said fourth fluid end plunger means at a fourth position as an initial suction plunger means;
inlet valve control means for controlling the positions of said first, second, third and fourth inlet valve means;
inlet valve detector means for detecting the positions of said first, second, third and fourth inlet valve means;
exhaust valve control means, responsive to said inlet valve detector means, for controlling the positions of said first, second, third and fourth exhaust valve means;
exhaust valve detector means for detecting the positions of said first, second, third and fourth exhaust valve means;
precompression circuit control means, responsive to said exhaust valve detector means, for controlling said first, second, third and fourth precompression circuit means;
phase control means for controlling the spacing between any of said first, second, third and fourth plunger means functioning as the leading discharge plunger means and any of said first, second, third and fourth plunger means functioning as the trailing discharge plunger means;
stop point control means for controlling the positions at which each of said first, second, third and fourth plunger means stops at the end of its movement as the leading discharge plunger means;
mode controls means for shifting said first, second, third and fourth power end piston means between a first mode of operation and a second mode of operation in response to the pressure and stroke of a drive pump to which said apparatus is connectible; and
means for operating said apparatus either in quadruplex wherein all of said four pumping sections are energizable or in triplex wherein only three of said four pumping sections are energizable, said means for operating said apparatus either in quadruplex or triplex including:
conversion switch means for initiating the conversion of the operation of said apparatus from quadruplex to triplex;
pumping section select switch means for selecting which one of said four pumping sections is to be disabled during triplex operation; and
timing means, responsive to said conversion switch means and said pumping section select switch means, for controlling the time when said apparatus switches to triplex operation.

15. A pumping apparatus, comprising:
a first pumping section including:
first power end piston means;
first fluid end plunger means;
first coupling means for coupling said first power end piston means with said first fluid end piston means;
first inlet valve means associated with said first power end piston means;
first exhaust valve means associated with said first power end piston means; and
first precompression circuit means associated with said first power end piston means;
a second pumping section including:
second power end piston means;
second fluid end plunger means;
second coupling means for coupling said second power end piston means with said second fluid end piston means;
second inlet valve means associated with said second power end piston means;
second exhaust valve means associated with said second power end piston means; and
second precompression circuit means associated with said second power end piston means;
a third pumping section including:
third power end piston means;
third fluid end plunger means;
third coupling means for coupling said third power end piston means with said third fluid end piston means;
third inlet valve means associated with said third power end piston means;
third exhaust valve means associated with said third power end piston means; and
third precompression circuit means associated with said third power end piston means;
a fourth pumping section including:
fourth power end piston means;
fourth fluid end plunger means;

fourth coupling means for coupling said fourth power end piston means with said fourth fluid end piston means;

fourth inlet valve means associated with said fourth power end piston means;

fourth exhaust valve means associated with said fourth power end piston means; and fourth precompression circuit means associated with said fourth power end piston means; and control means for controlling the operation of said four pumping sections, said control means including: initialization means for placing said first fluid end plunger means at a first position as an initial leading discharge plunger means, for placing said second fluid end plunger means at a second position as an initial trailing discharge plunger means, for placing said third fluid end plunger means at a third position as an initial precompression plunger means, and for placing said fourth fluid end plunger means at a fourth position as an initial suction plunger means;

inlet valve control means for controlling the positions of said first, second, third and fourth inlet valve means;

inlet valve detector means for detecting the positions of said first, second, third and fourth inlet valve means;

exhaust valve control means, responsive to said inlet valve detector means, for controlling the positions of said first, second, third and fourth exhaust valve means;

exhaust valve detector means for detecting the positions of said first, second, third and fourth exhaust valve means;

precompression circuit control means, responsive to said exhaust valve detector means, for controlling said first, second, third and fourth precompression circuit means;

phase control means for controlling the spacing between any of said first, second, third and fourth plunger means functioning as the leading discharge plunger means and any of said first, second, third and fourth plunger means functioning as the trailing discharge plunger means;

stop point control means for controlling the positions at which each of said first, second, third and fourth plunger means stops at the end of its movement as the leading discharge plunger means;

mode control means for shifting said first, second, third and fourth power end piston means between a first mode of operation and a second mode of operation in response to the pressure and stroke of a drive pump to which said apparatus is connectible;

means for operating said apparatus either in quadruplex wherein all of said four pumping sections are energizable or in triplex wherein only three of said four pumping sections are energizable;

encoder means for providing respective signals representing the actual positions of said first, second, third and fourth power end piston means; and means for controlling the quantity of a fluid contained in respective end portions of said first, second, third and fourth power end piston means, said means for controlling the quantity of a fluid including:

means for computing a required quantity proportional to the volume of fluid required in respective end portions of said first, second, third and fourth power end piston means, said means for computing a required quantity including:

means for determining an average precompression length;

means for adding the average precompression length to a predetermined stroke length of each of said plunger means;

means for multiplying the sum of the average precompression length and the predetermined stroke length by 1.5, thereby providing a product;

means for adding a predetermined minimum precompression length to said product;

means for determining the change in the position of the one of said first, second, third or fourth fluid end plunger means functioning as the trailing discharge plunger means over a predetermined period of time; and means for adding the change in position to the sum of the predetermined minimum precompression length and said product, thereby establishing a sum of required volume;

means for calculating an actual quantity proportional to the actual volume of fluid contained in the respective end portions of said first, second, third and fourth power end piston means, said means for calculating an actual quantity including means for adding all the detected actual positions of said first, second, third and fourth power end piston means, thereby establishing a sum of actual volume;

means for generating a difference signal representing the difference between said actual quantity and said required quantity, said means for generating a difference signal including means for subtracting said sum of required volume from said sum of actual volume; and means, responsive to said difference signal, for adding fluid to the respective end portions of said first, second, third and fourth power end piston means.

16. A pumping apparatus, comprising:

a first pumping section including:

first power end piston means;

means fluid end plunger means;

first coupling means for coupling said first power end piston means with said first fluid end piston means;

first inlet valve means associated with said first power end piston means;

first exhaust valve means associated with said first power end piston means; and first precompression circuit means associated with said first power end piston means;

a second pumping section including:

second power end piston means;

second fluid end plunger means;

second coupling means for coupling said second power end piston means with said second fluid end piston means;

second inlet valve means associated with said second power end piston means;

second exhaust valve means associated with said second power end piston means; and second precompression circuit means associated with said second power end piston means;

a third pumping section including:

third power end piston means;

third fluid end plunger means;

third coupling means for coupling said third power end piston means with said third fluid end piston means;

third inlet valve means associated with said third power end piston means;

third exhaust valve means associated with said third power end piston means; and third precompression circuit means associated with said third power end piston means;

a fourth pumping section including:

fourth power end piston means;

fourth fluid end plunger means;

fourth coupling means for coupling said fourth power end piston means with said fourth fluid end piston means;

fourth inlet valve means associated with said fourth power end piston means;

fourth exhaust valve means associated with said fourth power end piston means; and fourth precompression circuit means associated with said fourth power end piston means; and control means for controlling the operation of said four pumping sections, said control means including:

initialization means for placing said first fluid end plunger means at a first position as an initial leading discharge plunger means, for placing said second fluid end plunger means at a second position as an initial trailing discharge plunger means, for placing said third fluid end plunger means at a third position as an initial precompression plunger means, and for placing said fourth fluid end plunger means at a fourth position as an initial suction plunger means;

inlet valve control means for controlling the positions of said first, second, third and fourth inlet valve means;

inlet valve detector means for detecting the positions of said first, second, third and fourth inlet valve means;

exhaust valve control means, responsive to said inlet valve detector means, for controlling the positions of said first, second, third and fourth exhaust valve means;

exhaust valve detector means for detecting the positions of said first, second, third and fourth exhaust valve means;

precompression circuit control means, responsive to said exhaust valve detector means, for controlling said first, second, third and fourth precompression circuit means;

phase control means for controlling the spacing between any of said first, second, third and fourth plunger means functioning as the leading discharge plunger means and any of said first, second, third and fourth plunger means functioning as the trailing discharge plunger means;

stop point control means for controlling the positions at which each of said first, second, third and fourth plunger means stops at the end of its movement as the leading discharge plunger means; and means for operating said apparatus either in quadruplex wherein all of said four pumping sections are energizable or in triplex wherein only three of said four pumping sections are energizable, said means for operating said apparatus either in quadruplex or triplex including:

conversion switch means for initiating the conversion of the operation of said apparatus from quadruplex to triplex;

pumping section select switch means for selecting which one of said four pumping sections is to be disabled during triplex operation; and timing means, responsive to said conversion switch means and said pumping section select switch means, for controlling the time when said apparatus switches to triplex operation.

17. A pumping apparatus, comprising:

a first pumping section including:

first power end piston means;

first fluid end plunger means;

first coupling means for coupling said first power end piston means with said first fluid end piston means;

first inlet valve means associated with said first power end piston means;

first exhaust valve means associated with said first power end piston means; and first precompression circuit means associated with said first power end piston means;

a second pumping section including:

second power end piston means;

second fluid end plunger means;

second coupling means for coupling said second power end piston means with said second fluid end piston means;

second inlet valve means associated with said second power end piston means;

second exhaust valve means associated with said second power end piston means; and second precompression circuit means associated with said second power end piston means;

a third pumping section including:

third power end piston means;

third fluid end plunger means;

third coupling means for coupling said third power end piston means with said third fluid end piston means;

third inlet valve means associated with said third power end piston means;

third exhaust valve means associated with said third power end piston means; and third precompression circuit means associated with said third power end piston means;

a fourth pumping section including:

fourth power end piston means;

fourth fluid end plunger means;

fourth coupling means for coupling said fourth power end piston means with said fourth fluid end piston means;

fourth inlet valve means associated with said fourth power end piston means;

fourth exhaust valve means associated with said fourth power end piston means; and fourth precompression circuit means associated with said fourth power end piston means; and control means for controlling the operation of said four pumping sections, said control means including:

initialization means for placing said first fluid end plunger means at a first position as an initial leading discharge plunger means, for placing said second fluid end plunger means at a second position as an initial trailing discharge plunger means, for placing said third fluid end plunger means at a third position as an initial precompression plunger means, and for placing said fourth fluid end plunger means at a fourth position as an initial suction plunger means;

inlet valve control means for controlling the positions of said first, second, third and fourth inlet valve means;

inlet valve detector means for detecting the positions of said first, second, third and fourth inlet valve means;

exhaust valve control means, responsive to said inlet valve detector means, for controlling the positions of said first, second, third and fourth exhaust valve means;

exhaust valve detector means for detecting the positions of said first, second, third and fourth exhaust valve means;

precompression circuit control means, responsive to said exhaust valve detector means, for controlling said first, second, third and fourth precompression circuit means;

phase control means for controlling the spacing between any of said first, second, third and fourth plunger means functioning as the leading discharge plunger means and any of said first, second, third and fourth plunger means functioning as the trailing discharge plunger means;

stop point control means for controlling the positions at which each of said first, second, third and fourth plunger means stops at the end of its movement as the leading discharge plunger means;

means for operating said apparatus either in quadruplex wherein all of said fourth pumping sections are energizable or in triplex wherein only three of said four pumping sections are energizable;

encoder means for providing respective signals representing the actual positions of said first, second, third and fourth power end piston means; and means for controlling the quantity of a fluid contained in respective end portions of said first, second, third and fourth power end piston means, said means for controlling the quantity of a fluid including:

means for computing a required quantity proportional to the volume of fluid required in respective end portions of said first, second, third and fourth power end piston means, said means for computing a required quantity including;

means for determining an average precompression length;

means for adding the average precompression length to a predetermined stroke length of each of said plunger means;

means for multiplying the sum of the average precompression length and the predetermined stroke length by 1.5, thereby providing a product;

means for adding a predetermined minimum precompression length to said product;

means for determining the change in the position of the one of said first, second, third or fourth fluid end plunger means functioning as the trailing discharge plunger means over a predetermined period of time; and means for adding the change in position to the sum of the predetermined minimum precompression length and said product, thereby establishing a sum of required volume;

means for calculating an actual quantity proportional to the actual volume of fluid contained in the respective end portions of said first, second, third and fourth power end piston means, said means for calculating an actual quantity including means for adding all the detected actual positions of said first, second, third and fourth power end piston means, thereby establishing a sum of actual volume;

means for generating a difference signal representing the difference between said actual quantity and said required quantity, said means for generating a difference signal including means for subtracting said sum of required volume from said sum of actual volume; and means, responsive to said difference signal, for adding fluid to the respective end portions of said first, second, third and fourth power end piston means.

18. A pumping apparatus, comprising:

a first pumping section including:

first power end piston means;

first fluid end plunger means;

first coupling means for coupling said first power end piston means with said first fluid end piston means;

first inlet valve means associated with said first power end piston means;

first exhaust valve means associated with said first power end piston means; and first precompression circuit means associated with said first power end piston means;

a second pumping section including:

second power end piston means;

second fluid end plunger means;

second coupling means for coupling said second power end piston means with said second fluid end piston means;

second inlet valve means associated with said second power end piston means;

second exhaust valve means associated with said second power end piston means; and second precompression circuit means associated with said second power end piston means;

a third pumping section including:

third power end piston means;

third fluid end plunger means;

third coupling means for coupling said third power end piston means with said third fluid end piston means;

third inlet valve means associated with said third power end piston means;

third exhaust valve means associated with said third power end piston means; and third precompression circuit means associated with said third power end piston means;

a fourth pumping section including:

fourth power end piston means;

fourth fluid end plunger means;

fourth coupling means for coupling said fourth power end piston means with said fourth fluid end piston means;

fourth inlet valve means associated with said fourth power end piston means;

fourth exhaust valve means associated with said fourth power end piston means; and fourth precompression circuit means associated with said fourth power end piston means; and control means for controlling the operation of said four pumping sections, said control means including:

initialization means for placing said first fluid end plunger means at a first position as an initial leading discharge plunger means, for placing said second fluid end plunger means at a second position as an initial trailing discharge plunger means, for placing said third fluid end plunger means at a third position as an initial precompression plunger means, and for placing said fourth fluid end plunger means at a fourth position as an initial suction plunger means;

inlet valve control means for controlling the positions of said first, second, third and fourth inlet valve means;

inlet valve detector means for detecting the positions of said first, second, third and fourth inlet valve means;

exhaust valve control means, respective to said inlet valve detector means, for controlling the positions of said first, second, third and fourth exhaust valve means;

exhaust valve detector means for detecting the positions of said first, second, third and fourth exhaust valve means;

precompression circuit control means, responsive to said exhaust valve detector means, for controlling said first, second, third and fourth precompression circuit means;

phase control means for controlling the spacing between any of said first, second, third and fourth plunger means functioning as the leading discharge plunger means and any of said first, second, third and fourth plunger means functioning as the trailing discharge plunger means;

stop point control means for controlling the positions at which each of said first, second, third and fourth plunger means stops at the end of its movement as the leading discharge plunger means;

encoder means for providing respective signals representing the actual positions of said first, second, third and fourth power end piston means; and means for controlling the quantity of a fluid contained in respective end portions of said first, second, third and fourth power end piston means, said means for controlling the quantity of a fluid including:

means for computing a required quantity proportional to the volume of fluid required in respective end portions of said first, second, third and fourth power end piston means, said means for computing a required quantity including:

means for determining an average precompression length;

means for adding the average precompression length to a predetermined stroke length of each of said plunger means;

means for multiplying the sum of the average precompression length and the predetermined stroke length by 1.5, thereby providing a product;

means for adding a predetermined minimum precompression length to said product;

means for determining the change in the position of the one of said first, second, third or fourth fluid end plunger means functioning as the trailing discharge plunger means over a predetermined period of time; and means for adding the change in position to the sum of the predetermined minimum precompression length and said product, thereby establishing a sum of required volume;

means for calculating an actual quantity proportional to the actual volume of fluid contained in the respective end portions of said first, second, third and fourth power end piston means, said means for calculating an actual quantity including means for adding all the detected actual positions of said first, second, third and fourth power end piston means, thereby establishing a sum of actual volume;

means for generating a difference signal representing the difference between said actual quantity and said required quantity, said means for generating a difference signal including means for subtracting said sum of required volume from said sum of actual volume; and means, responsive to said difference signal, for adding fluid to the respective end portions of said first, second, third and fourth power end piston means.

* * * * *

UNITED STATES PATENT AND TRADEMARK OFFICE

CERTIFICATE OF CORRECTION

PATENT NO. : 4,527,954

DATED : July 9, 1985

INVENTOR(S) : Murali et al.

It is certified that error appears in the above-identified patent and that said Letters Patent is hereby corrected as shown below:

In the "ABSTRACT", lines 14 and 15, delete the word [elecrtronic] and insert therefor --electronic--.

In column 10, line 44, delete the word [predetermined] and insert therefor --predetermining--.

In column 12, line 48, delete the word [time] and insert therefor --timer--.

In column 18, line 24, delete [$C_4 \cdot (I_1\bar{I}_2\bar{I}_3I_4 + I_1\bar{I}_2\bar{I}_3I_4 + I_1I_2\bar{I}_3\bar{I}_4)$] and insert therefor --$C_4 \cdot (I_1\bar{I}_2\bar{I}_3I_4 + I_1\bar{I}_2\bar{I}_3\bar{I}_4 + I_1I_2\bar{I}_3\bar{I}_4)$--.

UNITED STATES PATENT AND TRADEMARK OFFICE

CERTIFICATE OF CORRECTION

PATENT NO. : 4,527,954

DATED : July 9, 1985

INVENTOR(S) : Murali et al.

It is certified that error appears in the above-identified patent and that said Letters Patent is hereby corrected as shown below:

In column 18, Appendix 5, following line 53, insert

--$P_4 = Q \cdot (E_1\bar{E}_2\bar{E}_3\bar{E}_4 + E_1E_2\bar{E}_3\bar{E}_4) +$ $C_1 \cdot (\bar{E}_1E_2\bar{E}_3\bar{E}_4 + \bar{E}_1E_2E_3\bar{E}_4) +$ $C_2 \cdot (E_1\bar{E}_2\bar{E}_3\bar{E}_4 + E_1\bar{E}_2E_3\bar{E}_4) +$ $C_3 \cdot (E_1\bar{E}_2\bar{E}_3\bar{E}_4 + E_1E_2\bar{E}_3\bar{E}_4)$--

In column 30, line 8, delete the word [controls] and insert therefor --control--.

In column 35, line 31, delete the word [fourth] and insert therefor --four--.

In column 37, line 17, delete the word [respective] and insert therefor --responsive--.

Signed and Sealed this

Seventh Day of October, 1986

[SEAL]

*Attest:*

DONALD J. QUIGG

*Attesting Officer*

*Commissioner of Patents and Trademarks*